US010643423B2

(12) United States Patent
Lyons et al.

(10) Patent No.: US 10,643,423 B2
(45) Date of Patent: May 5, 2020

(54) SYSTEM AND DIGITAL TABLE FOR BINDING A MOBILE DEVICE TO A POSITION AT THE TABLE FOR TRANSACTIONS

(71) Applicant: Scientific Games, Inc., Las Vegas, NV (US)

(72) Inventors: Martin Lyons, Henderson, NV (US); Scott Hilbert, Sparks, NV (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/713,333

(22) Filed: Sep. 22, 2017

(65) Prior Publication Data

US 2018/0108207 A1 Apr. 19, 2018

Related U.S. Application Data

(60) Provisional application No. 62/399,037, filed on Sep. 23, 2016.

(51) Int. Cl.
*G07F 17/32* (2006.01)

(52) U.S. Cl.
CPC ..... *G07F 17/322* (2013.01); *G07F 17/3211* (2013.01); *G07F 17/3244* (2013.01); *G07F 17/3265* (2013.01); *G07F 17/3293* (2013.01)

(58) Field of Classification Search
CPC ..... G07F 17/3211; G07F 17/322; G07F 17/3244; G07F 17/3265; G07F 17/3293
USPC ..... 463/34
See application file for complete search history.

(56) References Cited

U.S. PATENT DOCUMENTS

| | | | | |
|---|---|---|---|---|
| 5,761,647 | A | 6/1998 | Boushy | |
| 6,890,258 | B2 | 5/2005 | Weiss | |
| 8,002,619 | B2 | 8/2011 | Gagner et al. | |
| 8,147,316 | B2 | 4/2012 | Arezina et al. | |
| 8,241,123 | B2 | 8/2012 | Kelly et al. | |
| 8,333,655 | B2 | 12/2012 | Gagner et al. | |
| 8,376,838 | B2 | 2/2013 | Schulhof et al. | |
| 8,430,405 | B2 | 4/2013 | Gagner et al. | |
| 8,449,372 | B2 | 5/2013 | Glenn, II et al. | |
| 8,821,274 | B2 * | 9/2014 | Lyons | G07F 17/3241 463/31 |

(Continued)

*Primary Examiner* — Dmitry Suhol
*Assistant Examiner* — Ryan Hsu
(74) *Attorney, Agent, or Firm* — Michael Blankstein; Daniel Salgado

(57) ABSTRACT

A system, digital table and method for binding a mobile device to a location on the digital table are disclosed. The digital table has a transparent substrate, a diffuse cloth layer having the feel of felt and suitable for backlighting with an interposed compressible layer. A wireless table transceiver is provided to detect a mobile device on the table and to cause the mobile device to emit a code with its camera flash detected by an optical receiver to bind the mobile device to a specific location on the gaming table surface. Content such as digital images or lighting arrangements are directed through the substrate and compressible layer to the underside of the cloth where they are visible at the cloth layer adjacent to the mobile device location. In an embodiment the orientation of the mobile device may be determined for configuring content. Interaction between the mobile device and table is supported to move virtual items such as gaming chips between the mobile device and the digital table.

26 Claims, 14 Drawing Sheets

(56) References Cited

U.S. PATENT DOCUMENTS

| | | | | |
|---|---|---|---|---|
| 8,967,218 | B2 | 3/2015 | Lee et al. | |
| 9,142,098 | B2 | 9/2015 | Gagner et al. | |
| 9,387,390 | B2 | 7/2016 | Downs, III et al. | |
| 9,573,053 | B2 * | 2/2017 | Aoki | G06T 19/006 |
| 9,619,968 | B2 | 4/2017 | Gagner et al. | |
| 9,747,749 | B1 | 8/2017 | Wisler et al. | |
| 9,896,677 | B2 | 2/2018 | Bjelke | |
| 10,046,232 | B2 * | 8/2018 | Aoki | G07F 17/322 |
| 2003/0067623 | A1 * | 4/2003 | Akiyama | H04N 1/00209 358/1.15 |
| 2009/0115133 | A1 * | 5/2009 | Kelly | G07F 17/32 273/274 |
| 2009/0124383 | A1 | 5/2009 | Gadda et al. | |
| 2009/0143141 | A1 | 6/2009 | Wells et al. | |
| 2011/0207531 | A1 * | 8/2011 | Gagner | G07F 17/3248 463/30 |
| 2011/0263326 | A1 | 10/2011 | Gagner et al. | |
| 2014/0038141 | A1 | 2/2014 | Burza et al. | |
| 2014/0349726 | A1 | 11/2014 | Buchholz et al. | |
| 2014/0364199 | A1 * | 12/2014 | Baerlocher | G07F 17/3244 463/25 |
| 2015/0228153 | A1 | 8/2015 | Hedrick et al. | |
| 2016/0093154 | A1 * | 3/2016 | Bytnar | G07F 17/3218 463/25 |
| 2016/0093166 | A1 | 3/2016 | Panambur et al. | |

* cited by examiner

SYSTEM AND DIGITAL TABLE FOR BINDING A MOBILE DEVICE TO A POSITION AT THE TABLE FOR TRANSACTIONS

CROSS-REFERENCE TO RELATED APPLICATIONS

This application is a utility patent application based upon and claiming priority to prior filed U.S. provisional patent application Ser. No. 62/399,037 filed Sep. 23, 2016 and titled "System and Digital Table for Binding a Mobile Device to a Position at the Table for Transactions".

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to tables or surfaces with electronic displays such as gaming tables and for binding mobile devices to a position at the table or surface support interactions such as content displays and transactions between the mobile device and the surface or table.

BACKGROUND OF THE INVENTION

Games such as Blackjack tables have a loyal following of players. Casinos typically have numerous Blackjack tables to accommodate these players. Other such table games include Pai Gow, Three-card Poker, Ultimate Texas Hold'em and other live, table based, card games. Other live table games which do not use playing cards include Craps, Roulette and Sic Bo. By being "live" the game uses physical game pieces such as playing cards, dice, domino tiles (such as Chinese Pai Gow), a Roulette wheel, gaming chips, presents a physical play surface and typically has a physical dealer to control the play of the game and resolve the players' wagers. For table games using playing cards the cards are dealt from an inventory representing one or more shuffled decks of cards; whether dealt by hand or with the use of a shoe or shuffling device.

It is believed that the loyalty of players particularly for table card games is based, at least in part, upon the tradition associated with the these live games, the use of physical cards dealt from an inventory which is depleted with every round to assure player the game is fair and the ability of the players to hold and handle the physical cards. Tradition surrounds such games since they have been around, in one form or another, for many years. Players have seen the games on television and movies and have played these games in this format for many years. Fairness of the game operation is supported by dealing physical cards from one or more decks, shoes of shuffling devices. Electronic games with virtual cards are known and have been in use in casinos and in internet gaming where the values and suits of the cards are based upon a random number generator and each hand or round of play is dealt from a newly randomly sorted, reconstituted inventory, i.e. the players cannot see a physical card inventory depleted with each round of play as with dealing physical cards from a deck or shoe. In a virtual game such as Blackjack where the position of the dealer appears to routinely get good hands, this run of dealer "good luck" may give players the impression that the game software gives the dealer an unfair advantage. For at least some of these reasons players of traditional table games may prefer live games to their virtual counterpart.

The construction of a traditional gaming table top includes an opaque, colored, cloth felt surface. Felt fabric has been the longstanding surface covering for such tables based perhaps upon tradition, durability, feel and to facilitate the dealing and picking up of cards. Interposed between the felt and rigid table top substrate of plywood, is cushioning, compressible, fabric padding. The fabric padding enables a degree of compressibility of the felt and provides a bias to maintain the felt stretched over the substrate. A benefit of this arrangement is that to pick up a card a player's fingers can locally depress the felt at a margin of the card for gripping the card. Because cards are planar and somewhat rigid, picking them up from a rigid, smooth, flat table surface is difficult. The planar surfaces of the cards may tend to adhere to the smooth planar table surface through a mechanism referred to as "wringing". To overcome this wringing a player must pry or bend a margin of the card from the surface, which can mar the card, or must slide the card to the edge of the table. Where the table has a raised bumper at the edge like a typical Blackjack table, prying or bending of the card would be the typical approach. Players may use prying or bending to mark the cards or may bend the cards to an extent that they are no longer suitable for play or may foul an automatic shuffler. If there is moisture on the table surface or the card "wringing" adherence can be enhanced. Even without the wringing phenomenon, picking up cards from a rigid surface may require bending the cards.

There is a failing regarding traditional gaming tables. To change the game at a table from for example Blackjack to Pai Gow the printed felt fabric must be removed and replaced to reflect the new felt printed with the appropriate game play layout and information related to the new game. These felts are typically screen or transfer printed. The table is removed from service and technicians remove a cushioned bumper along an edge of the table, disconnect and remove the old felt. The new felt is positioned, trimmed if necessary, secured to the table and the padded bumper is replaced. This process has a cost to the casino in printing a new felt, taking the table out of service and the labor costs for the replacement. Further the change may require a lag time awaiting the printing of the new fabric. Thus changes cannot quickly be made to accommodate changes in demand. Layouts are changed not only to reflect a change in the game but to provide, for example, a layout to support a Blackjack game having different side bet options and to delineate where wagers are to be placed, minimum wagers, a pay table and the like.

A further drawback is that the information on the traditional gaming table is static. Video text and graphics cannot be presented. It has been suggested to project video content from above onto the gaming tables by Glenn, II: et al, U.S. Pat. No. 8,449,372 filed Nov. 10, 2008 and titled "Wagering Game With a Table-Game Configuration" and Arezina et al U.S. Pat. No. 8,147,316 filed Oct. 10, 2007 and titled "Multi-player, Multi-Touch Table for Use in Wagering Game Systems". However projecting content onto a table from above creates distracting shadows cast by cards, the dealer's hands, player's hands and the like. Players of traditional felt games may find these projected versions unattractive. Further making the content interactive responsive to player input is a challenge.

In Gagner et al, U.S. Pat. No. 8,430,405 filed Nov. 14, 20101 and titled "Multi-Projection Gaming Table" content is projected from underneath the table surface. However this arrangement does not address the problem of giving players of the traditional felt table games the look and feel of the traditional game and does not address the issue of picking up the cards from a smooth, flat surface. This departure from the felt game creates a negative impression for players preferring a traditional live table.

In Gadda et al, US Pub App 2009/0124383 filed Nov. 9, 2007 and titled "Apparatus for Use with Interactive table Games and Methods of Use" there is a disclosed a game table which projects content from a projector to the underside of a table top having a translucent surface. Again the departure from the traditional look and feel of the traditional felt table and the failure to address the difficulty in picking up cards creates a negative impression for traditional live table players. Further the problem of wringing is not addressed.

In a somewhat related field, it has been known to provide player loyalty systems for casino venues. Such systems provide for enrollment of players into the system so they can have their commercial activity, such as gaming, tracked for the purpose of obtaining access to awards such as points which can be redeemed for cash back, goods or services. Once enrolled the player is typically issued a player card with the machine-readable magnetic stripe. Card readers at gaming devices read a player's card, provide access to a player's loyalty system account and track the player's wagering activities to award redeemable points. One such system is described in Boushy, U.S. Pat. No. 5,761,647 filed May 24, 1996 and issued Jun. 2, 1998. These player tracking systems include, usually associated with the card reader, a system interface with a display and player input apparatus. Historically the displays were multi-line VFD's but modernly are LED video displays with touch screen functionality. Bally Gaming, Inc. provides such system interfaces, i.e. player tracking modules, under the name of "iView". In Kelly et al, U.S. Pat. No. 8,241,123 filed Jan. 8, 2009 and issued Aug. 14, 2012 and titled "Video Switcher and Touch Router Method for a Gaming Machine" there is a disclosed an arrangement where the player-system interface and display is migrated to the gaming terminal video display.

Since traditional table games do not include a player-system interface, to track a player's table play the usual technique is for casino personnel to log-in a player in using a card reader and then visually monitor the player's average bet and record the same into the system. In this fashion the player's gaining activities can be approximated and tracked for purposes of determining points or other awards for the player and the commercial value of the customer to the casino.

In Weiss, U.S. Pat. No. 6,890,258 filed Jul. 26, 2002 and issued May 10, 2005 it has also been suggested to use a player card to access and download or upload electronic funds for gaming.

In the prior art it has also been known to provide ticket-in, ticket-out ("TITO") functionality for gaming devices. In this arrangement gaming devices are provided with a ticket printer and a ticket reader. When a player cashes out credits from the gaming machines, e.g. $35, the gaming device, in cooperation with a supporting system, configures prints and dispenses a printed ticket showing the amount and bearing a machine readable code. The player can either cash the ticket out for currency at a kiosk or with a cashier or can insert it in a ticket reader at a gaming device. The reader reads the code, calls the system to confirm authenticity and instructs the gaming device controller to load the ticket value of $35 onto the credit meter for the gaming device. With TITO coin hoppers are no longer required and the convenience and mobility of players is enhanced. Such systems are disclosed in Gagner et al, U.S. Pat. No. 9,142,098 issued Sep. 22, 2015 and titled "Managing Cashless Wagering Game Systems" the disclosure of which is incorporated by reference. Traditional gaming tables as described above do not support TITO where players wager with currency or gaming chips.

There is a need for a table which is adapted for the play of a game using physical cards, which can be used with a live or virtual dealer, which provides the look and feel of a traditional felt table, and which provides for the video rendition of content at the table in various forms such as different game layouts and content delivered from different sources. There is a need for a table which provides these features and advantages and includes touch-input functionality such as is available to video gaming machines. There is a need to provide system-interface functionality at a gaming table whereby players may access and manage their player accounts and enable electronic fund transfers and which can utilize TITO functionality.

It has also been known for players to wirelessly bind or "pair" a mobile device with a gaming terminal and to access a user's account as disclosed in Shenoy et al, US2016/0093166, filed Sep. 29, 2014 and titled "System and Method for Wireless Card-In/Card-Out" and to fund play from an electronic wallet ("eWallet") otherwise known as an electronic account as described in Lyons et al, US2015/0228153, filed Sep. 26, 2014 and titled "System and Method for Remote Control Gaming Sessions Using a Mobile Device. However due to the nature of existing live tables games with numerous players in close proximity with no means to bind a particular player mobile device to a particular table position, such techniques have not been available.

Outside of gaming in situations where a mobile device users in close proximity such that passive location techniques such as GPS, wireless proximity detection techniques such as Bluetooth low energy (BLE) or triangulation cannot distinguish a position of one mobile device from another closely nearby device, mobile binding and utilization of that binding has not been exploited. For example, at a mobile cashier counter or table it is not possible for multiple users to engage in simultaneous mobile purchase transactions since there is no binding of the user's device with a specific position at the counter. In a gaming table such as a Blackjack table such proximity detectors cannot distinguish the position of one mobile device from another at the table. It would be advantageous in various commercial settings such transactions with brick and mortar enterprises to be able to wireless detect a user's mobile device, determine the position of that device as distinguished from devices of other users in close proximity and to provide specific user content to the determined position for the user or engage in a transaction.

Associated with gaming tables it has been known to provide spots or locations for automatic detection of the placement of a chip or token to register a bet or entry into a progressive. For example, Wisler, et al U.S. Pat. No. 9,747,749 titled "Multi-Wager Casino Games with Token Detection" discloses a token detector (for detecting the placement of a progressive wager at a gaming table) embodied as a container installed into a gaming table which includes a transparent cover and a light emitter for detection of a token placed on the cover.

Turning to mobile devices such as mobile telephones, these devices modernly include utilities such as wireless communication capability, accelerometers to detect movement, a gyroscope to detect orientation of the device in space, a camera with a flash and a touch screen digital display to display content and receive inputs. The display denotes the front of the device. A camera a flash unit are disposed at the back. It would be advantageous to utilize one or more of these mobile device utilities to bind the mobile device to a location at the table or surface.

SUMMARY OF THE INVENTION

According to one aspect of the present invention, a surface such as a table top is provided for displaying content from an image source. The surface includes a rigid substrate. In one embodiment the substrate is a transparent substrate. In an embodiment a diffuse, non-opaque synthetic cloth layer is secured to the substrate. Interposed between the substrate and cloth layer is a transparent compressible layer to enable deflection of the cloth layer relative to the substrate. Video content from a source such an arrangement of lights or as a digital projector can be projected through the substrate, compressible layer to backlight the content at the cloth layer for the user(s) to see.

Associated with the surface is a wireless transceiver and an optical receiver such as a camera. Configured by an application added to a mobile device such as by downloading, when the mobile device nears the surface its proximity is determined based upon a wireless signal received by or from the surface transceiver. The wireless signal may originate from the wireless device or be sent by the wireless device in response to a wireless interrogation signal from the surface wireless transceiver. A processor in communication with the surface wireless transceiver or the processor for the mobile device determines that the mobile device is in the proximity of the surface. This proximity determination may include the exchange of data such as to identify the surface and the mobile device. The proximity determination may access the mobile device utilities of the accelerometer and gyroscope to determine that the mobile device is resting upon the surface. In this position the flash of the mobile device is activated to flash a signal, which may be a relatively unique code, received by the optical receiver such as by passing through the surface or a window thereof. The processor receives data from the optical receiver to determine the specific location of the mobile device at the surface, to the exclusion of other mobile devices on the surface, based upon the camera flash signals.

In an embodiment the projector may display content at the determined location such as advertising, game related content, player tracking and eWallet account information or promotions.

In an embodiment when the location of the mobile device on the surface has been determined the projector may project a white light area at the determined location which results in a shadow from the mobile device resting on the surface. This shadow is detected by the optical receiver and the shadow signal is processed by the processor to determine the orientation footprint of the mobile device. With the location and orientation of the mobile device determined the projected content may be configured to be displayed so as not to be obscured by the mobile device. Further, in view of the wireless binding of the device to the surface actions such as funds transfers may be accomplished by, in effect, swiping fund representing icons from the mobile device to the surface. In an example, a player at a gaming table surface may access their eWallet funds, represented as one or more gaming chip icons on their mobile device display. Using their finger the player may swipe a chip from their mobile device display onto a visualization on the gaming surface to use to post a wager. Conversely chips may be moved from the table surface back onto the mobile device and its display. If the player terminates the gaming session or picks up their mobile device from the gaming table surface, the remaining funds are returned to their eWallet account.

In an embodiment the surface may be opaque but includes non-opaque locations for placing the mobile device to effectuate the locational and positional binding of the mobile device to the surface.

In an embodiment to support back betting or remote betting a non-opaque region may be provided on a gaming table surface. A player places their mobile device on the region and the processor establishes a binding with the mobile device and locates it as being a remote or back bettor. The player may make wagers using their mobile device as registered at the table. When the player leaves the range of the surface wireless transceiver or terminates the gaming session remaining funds are returned to the player's eWallet account.

In an embodiment the surface may be configured as a digital game table having a transparent substrate such as polycarbonate or PMMA (poly(methyl methacrylate) with a compressible layer of a synthetic product such as clear encapsulation rubber having a Shore hardness of substantially between 10 and 35 covered with a diffuse woven fabric, polymer or glass having a felt-like finish suitable for backlighting. In an embodiment touch input functionality can be provided to sense and provide inputs based upon touches at the cloth surface. Touch functionality can be provided by a transparent, projected capacitance layer, light emitter and sensor arrays associated with the compressible layer or the surface if the cloth layer or touch sensing cameras to detect touch at the cloth layer and through the compressible layer and transparent substrate. Where the substrate is a video display or monitor with touch functionality, its touch functionality may be utilized.

To manufacture the table top in an embodiment the substrate, either the transparent substrate of video display/monitor is positioned and leveled horizontally. A confining barrier is arranged at the surface and transparent encapsulation rubber or other pourable synthetic fluid is poured, e.g. floated, over the substrate within the barrier and allowed to cure to define the smooth, level, compressible layer. The cloth layer is disposed, e.g, stretched, over the compressible layer and secured.

Where projected capacitance touch functionality is desired, a transparent sensor array (Nano-wire, ITO or metal mesh) is positioned over the substrate prior to introduction of the synthetic fluid.

In an embodiment the surface may be a mixed arrangement of opaque regions and transmissive regions or windows. For example a traditional, opaque, felt fabric table top for a gaming table may have windows fashioned according to this invention to accommodate electronic display of content. One example may be a Blackjack table felt having windows at designated player positions to include the diffuse cloth fabric suitable for rear-projection display of video content. This "composite" felt is disposed over the compressible layer. Video content is projected through these windows. The content may be, for example, pay tables, signals to instruct play or content from a source such as a remote server. In an embodiment the windows are provided with touch functionality and display information associated with a player loyalty or funds based account maintained at a remote server to accept promotions, access wagering funds, received bonuses and view advertising. These windows also support the unique binding of a user's mobile device as described above.

In embodiments where the surface is a gaming table ticket-in, ticket-out functionality may be provided to dispense and load value as credits for gaining displayed at the table. In some embodiments players may use funds from electronic accounts again accommodated by the digital display table and touch functionality.

In an embodiment the surface may be a counter provided to service multiple mobile device users. For example, at a mobile telephone merchant, the surface may permit multiple mobile telephone users to access their accounts, view content and engage in commercial transactions. The surface may be a check-in kiosk at an airport to enable multiple users to check in and confirm their travel.

Additional aspects of the invention will be apparent to those of ordinary skill in the art in view of the detailed description of various embodiments, which is made with reference to the drawings, a brief description of which is provided below.

Figure 1A:
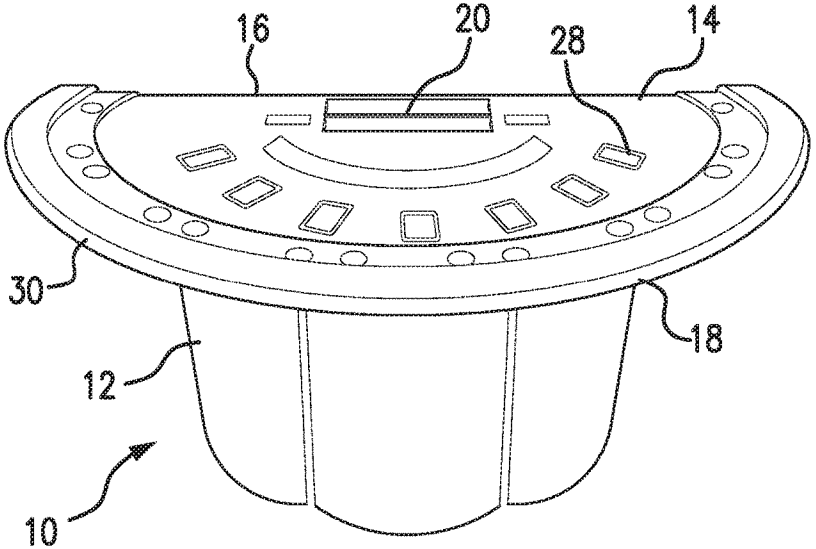
FIG. 1A (PRIOR ART)
FIGS. 1A-1C are front perspective, top and a partial section view, respectively, of examples of the construction of a Blackjack table according to the prior art.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of illustrating an embodiment of the invention, it will, unless otherwise indicated, be described with reference to casino-style table games. It should be understood that the invention has utility outside of gaming for environments such as in-home use gaming tables, pool tables, billiard tables and the like which traditionally have included a cloth felt surface.

An Embodiment of a Surface as a Digital Gaming Table

Figure 1B:
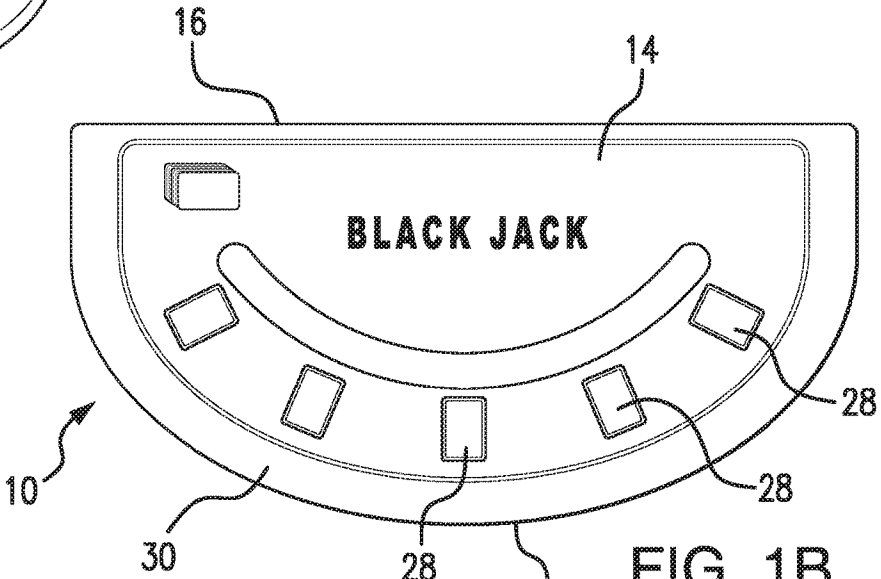
FIG. 1B (PRIOR ART)
Figure 1C:
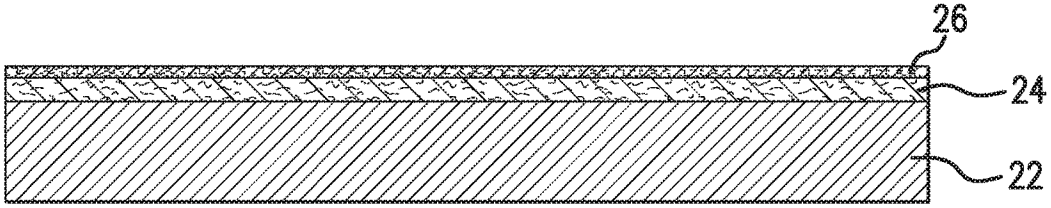
FIG. 1C (PRIOR ART)
Figure 2:
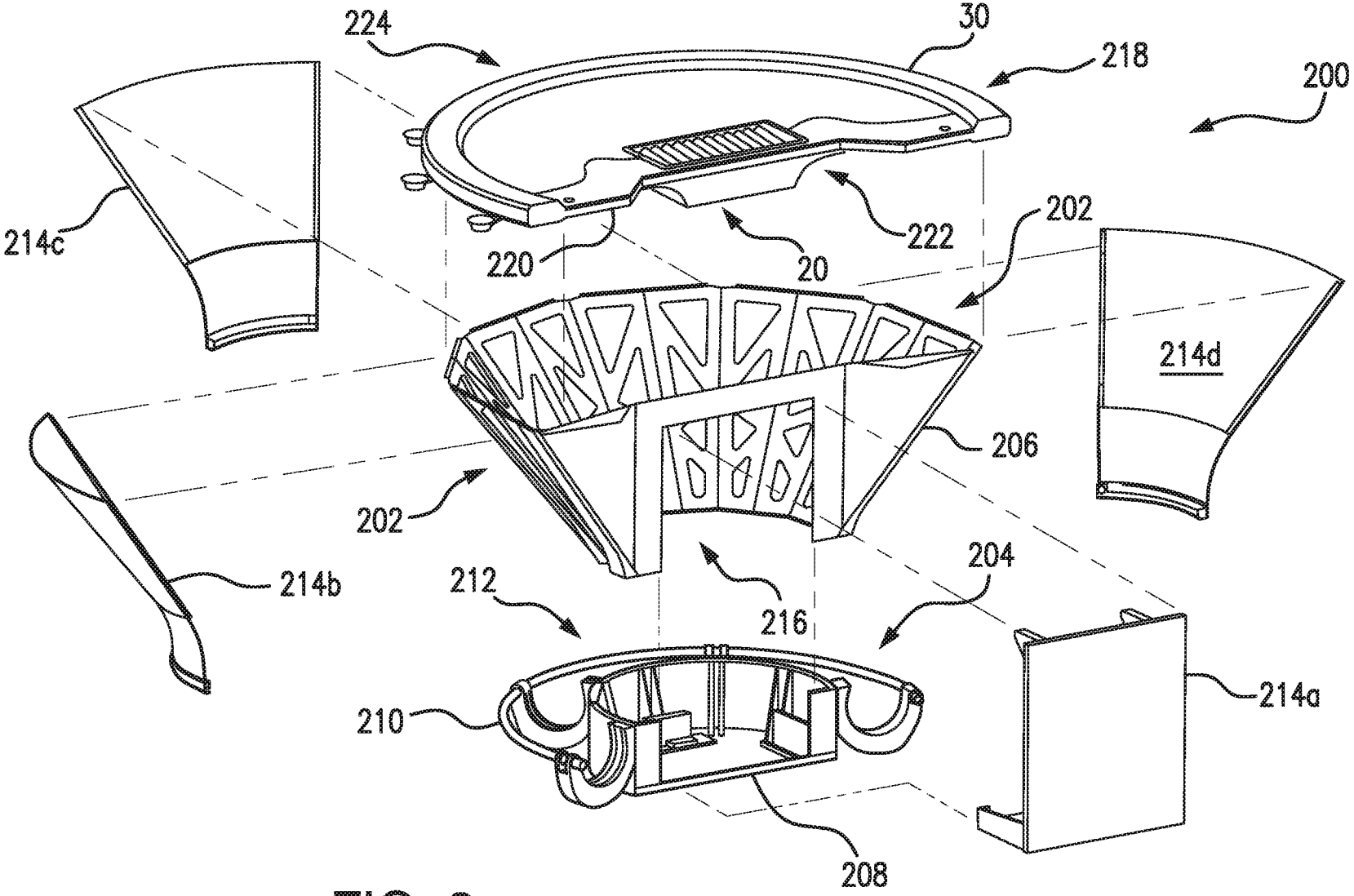
FIG. 2 is an exploded view of a table with the top according to an embodiment of the present invention.

While the surface for purposes of the present invention may take several forms such as a table top, counter top or other surface, an operative embodiment includes the surface configured as a digital Blackjack gaming table 10. Referring to FIGS. 1A-C examples of a Blackjack table 10 constructed according to the prior art are shown. The table 10 has an upstanding pedestal 12 supporting a table top 14. The pedestal 12 can have any desired shape or configuration and is recessed from the margins of the table top 14 to accommodate the legs of players seated about the table 10. The table top 14 includes a first edge 16 which may be substantially linear and a second, arcuate edge 18. A live dealer for the game stands proximate the first edge 14 while one or more players are typically seated about the second edge 18. FIG. 1A shows an embodiment including a cut-out in the top 14 to accommodate a chip tray 20 to hold the gaining chips used during play.

FIG. 1C shows the typical construction of a top 14 according to the prior art. A rigid opaque substrate 22 of plywood is cut into the desired shape of the top 14. Cut-outs such as for the chip tray 20 or other equipment are made as well. A sheet of opaque, compressible, cloth padding 24 is secured over the top surface of the substrate 22. The padding 24 may be glued or secured by fasteners to the substrate 22. Secured to the substrate 22 over the padding 24 typically with fasteners such as staples, is an opaque felt fabric 26 which, as shown in FIGS. 1A and 1B, has been printed with text and graphics. Printing may be done by screen printing. The printed text and graphics may include the game name, one or more pay tables for the game and denote player positions with graphics or, as shown, printed boxes 28 spaced about the top 14 along the second margin 18 to denote player positions. Once the fabric 26 has been secured a padded, arcuate, raised, padded, bumper 30 is secured to the substrate 22 along the second margin 18 to provide a cushion for the players' hands and arms.

As described above the padding 24 provides a degree of "compressibility" between the felt fabric 26 and the rigid substrate 22 to enable players to depress the felt cloth 26 at a margin of a playing card to pick it up. Further the texture of the felt fabric 26 avoids "wringing" contact adherence between the cards and the top 14.

When it is desired to change the game played at the table 10, a new felt fabric 26 is printed. The table 10 is taken out of service and workmen remove the bumper 30 and remove the old felt fabric 26. The replacement felt fabric 26 is secured to the substrate 22, trimmed if necessary and the bumper 30 is replaced. As can be appreciated this process incurs the cost of the purchase and printing of the felt fabric 26, the labor to make the change and the time the table 10 was out of service. Further printing of the felt fabric and the installation of a new game may hinder the ability to quickly respond to demands for new games.

Turning to FIGS. 2-5 an embodiment of the digital table 200 according to the present invention is shown. The digital table 200 includes a pedestal 202 having a base 204 to support an upstanding frame 206. The base 204 may be circular as shown and has a foot 208 to rest on the floor as well as a player footrest 210. A semi-circular pedestal support 212 mounts the frame 206 in an upright orientation. The panels 214*a-d* are secured to the frame 206 to enclose frame 206 and define an interior chamber 216 to hold and support electronic equipment as hereinafter described. Panel 214*a* may be flat and removeably attached to the frame 206 provide access to the chamber 216 and is attached to the side of the frame 206 and base 204 which will define the dealer's position for the table 200. Panels 214*b-d* are frustoconical to mate with the sides of the frame 206 and base 34 to enclose the chamber 43 and may be fashioned from, for example, a plastic or sheet metal material.

To provide a playing surface for the players and the dealer to table 200 includes a top 218 fashioned in a profile which may be reminiscent of prior art gaming tables such as table 14 of FIG. 1A. The top 218 has a first margin 220 to define the dealer's position and which may mount a chip tray 20 of the type described above disposed in a recess 222 at the first margin 220. To define the players' positions the top 218 has a semi-circular second margin 224. About the second margin 224 is a bumper 30 which may be of conventional construction.

Figure 3:
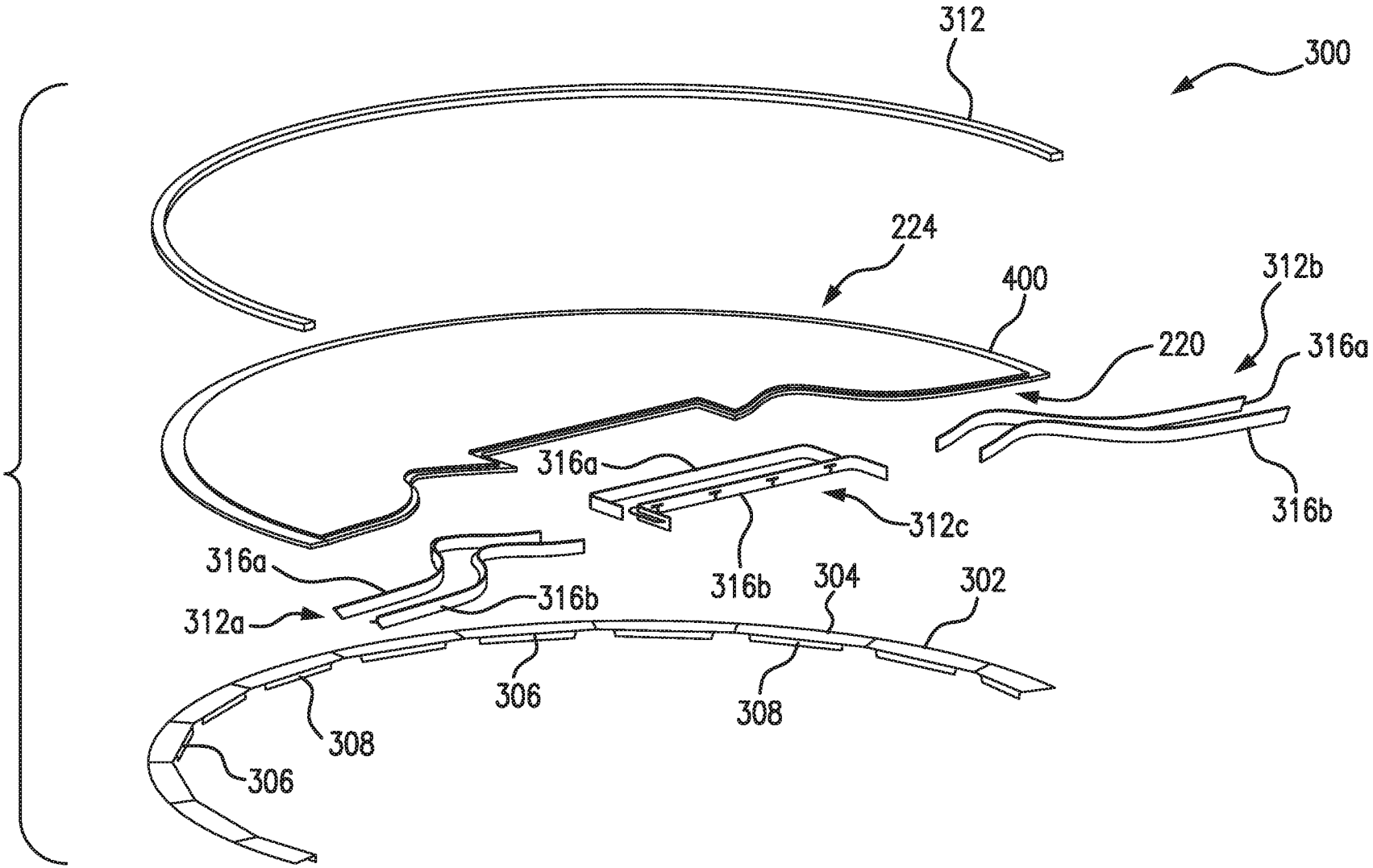
FIG. 3 is an exploded assembly view to illustrate the construction and method of the table top for the table of FIG. 2.
Figure 4:
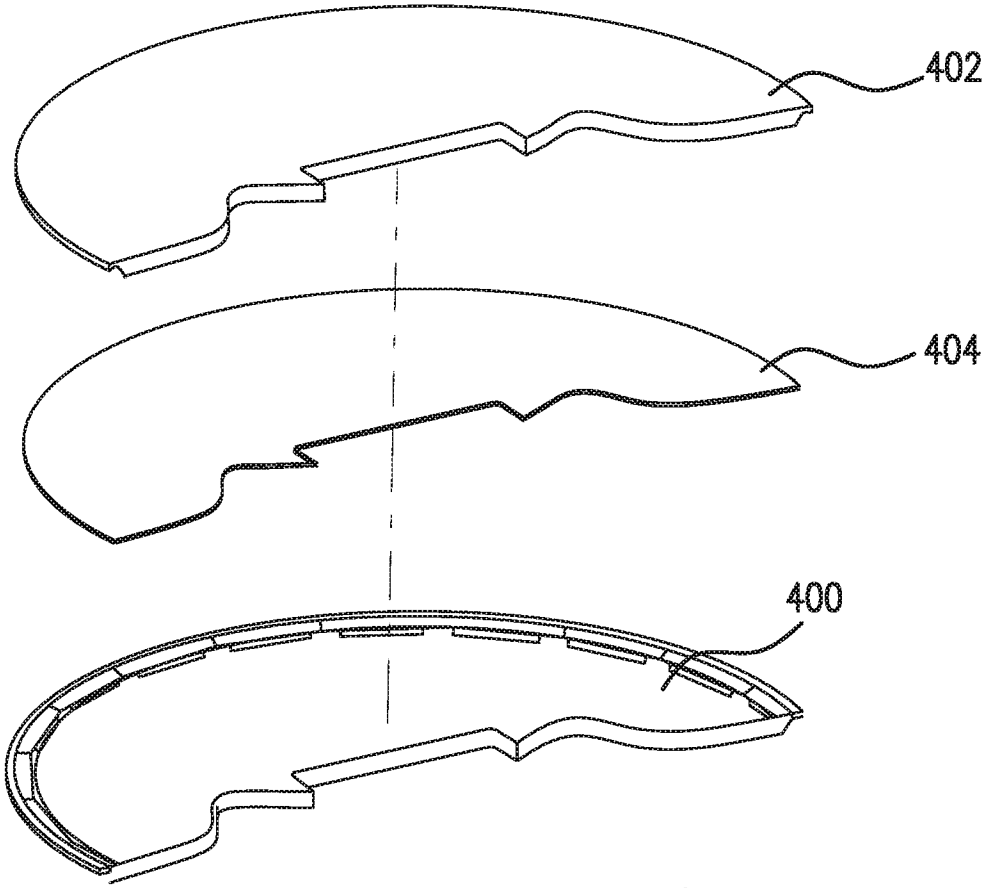
FIG. 4 illustrates the substrate and layers for the table top of the table of FIG. 2.
Figure 5A:
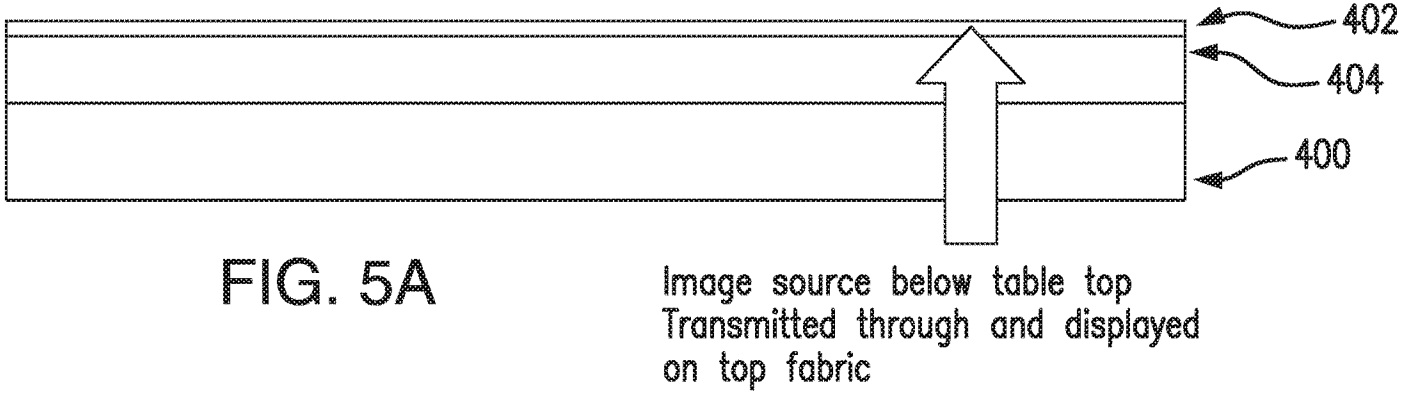
FIGS. 5A-5E are partial section views of the table top of FIG. 2 and further illustration inclusion of features to support touch input functionality.

FIGS. 3, 4 and 5A show the construction of the top 218 according to an embodiment of the present invention. To provide rigidity and support to the top 218, a rigid, transparent substrate 400 is provided in the desired shape for the top 218. Preferably the substrate 400 is glass or a clear plastic such as polycarbonate or PMMA (poly(methyl methacrylate)). It has been found that architectural glass such as that manufactured by Pilkington Building Products, North America, P.O. Box 799, 811 Madison Ave., Toledo Ohio 43697-0799 is a suitable, transparent and rigid substrate 400. 6 mm soda lime float tempered glass is also suitable for stability and rigidity.

The top 218 also includes a diffuse, non-opaque synthetic cloth layer 402 suitable for backlighting for the purposes described below. The layer may be a woven fabric, polymer or glass composite surface such as Crystal Silk™ produced and sold by 3M located at 3M Center, St. Paul, Minn. 55144-1000 or Celtic Cloth from Dazian, LLC 18 Central Blvd, South Hackensack, N.J. 07606. These products provide the feel of a felt cloth and enabled backlighting as hereinafter described.

Disposed between substrate 400 and the cloth layer 402 is a transparent, compressible layer 404. As described below the compressible layer 404 is fashioned with an optically clear silicone with a Shore A hardness of between 10 and 35. A compressible layer 404 with a Shore A hardness of 20 has been found adequate. Encapso®K from Smooth-On, Inc., 2000 Saint John St., Easton Pa. 18042 has been found to be a suitable product for the compressible layer 404.

The cloth layer 402 is stretched over the compressible layer 404 and secured to the substrate 400. The compressible layer 404 imposes a bias to maintain the cloth layer 402 taut and also enables the cloth layer 402 to be depressed relative to the rigid substrate 400. For example a player may depress the cloth layer 402 toward the rigid substrate 400 by pushing their finger to compress the compressible layer 404. This provides the feel of a traditional felt to the player and to facilitate the picking up of playing cards.

FIG. 5A shows a cross section of the construction of the top 218, The rigid, transparent substrate 400 supports the optically clear compressible layer 404 which, in turn, underlays the cloth layer 402. As can be appreciated an image source such as an arrangement of lights, a projector or one or more video display devices can direct the image from below through the substrate 400, compressible layer 404 to backlight the cloth layer 402 resulting in the image being presented at the cloth layer 402 for players to see. The image is preferably intense enough to overcome any ambient lighting around the table.

To mount the substrate 400 and provide for the placement of the compressible layer 404 and securing the cloth layer 402, a trim package 300 as illustrated in FIG. 3 is provided. The trim package 300 includes an arcuate band 302 having an upper surface 304 which may be defined by adjoining segments 306 each including a depending stop 308 to mate with and nest the arcuate contour for the substrate 400. Upper trim 310 having an arcuate configuration is secured to the band 302 as by fasteners such as screws. In profile the band 302 and upper trim 310 rise about the surface of the substrate 400. The upper trim 310 may trap the cloth 402 to the band 302 to secure the cloth 402 to the top 218. The band 302 and upper trim 310 may be manufactured from plastic or metal.

The trim package 300 also includes trim assemblies 312*a-c*. Trim assembly 312*a* includes first and second components 316*a, b* which are fashioned to mate with the profile of a portion of the first margin 220 and to be secured thereto. The first component 316*a* may be resilient such as a rubber material to seal against the substrate 400 whereas the second component 316*b* is rigid and is secured at an end thereof to the band 302. Trim assembly 312*b* also includes first and second components 316*a, b* fashioned as a mirror image of the first and second components 316*a, b* for the first component 316*a* and are likewise adapted to be secured and seal to the first margin of the substrate 400. Intermediate the trim assemblies 314*a* and *b*, trim assembly 314*c* includes first and second components 316*a, b* adapted to be secured to the substrate 400 and neighboring trim assemblies 314*a, b* and to frame a cutout to receive a chip tray. Like the band 302 and upper trim 312 the trim assemblies 314*a-c* seal against and rise above the surface of the substrate 400.

Figure 8:
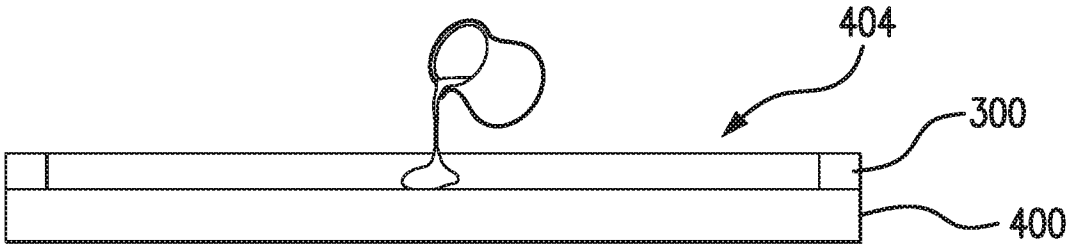
FIG. 8 illustrates a method for floating the compressible layer over the substrate.

In an embodiment where the compressible layer 404 is fashioned using a pourable compound such as Encapso®K the trim package 300 is secured to the substrate 400 and the substrate 400 is laid flat and level. The compound is poured or floated over the substrate 400 confined by the trim package 300 as suggested ion FIG. 8. The compound sets up to define the compressible layer 404.

Figure 6:
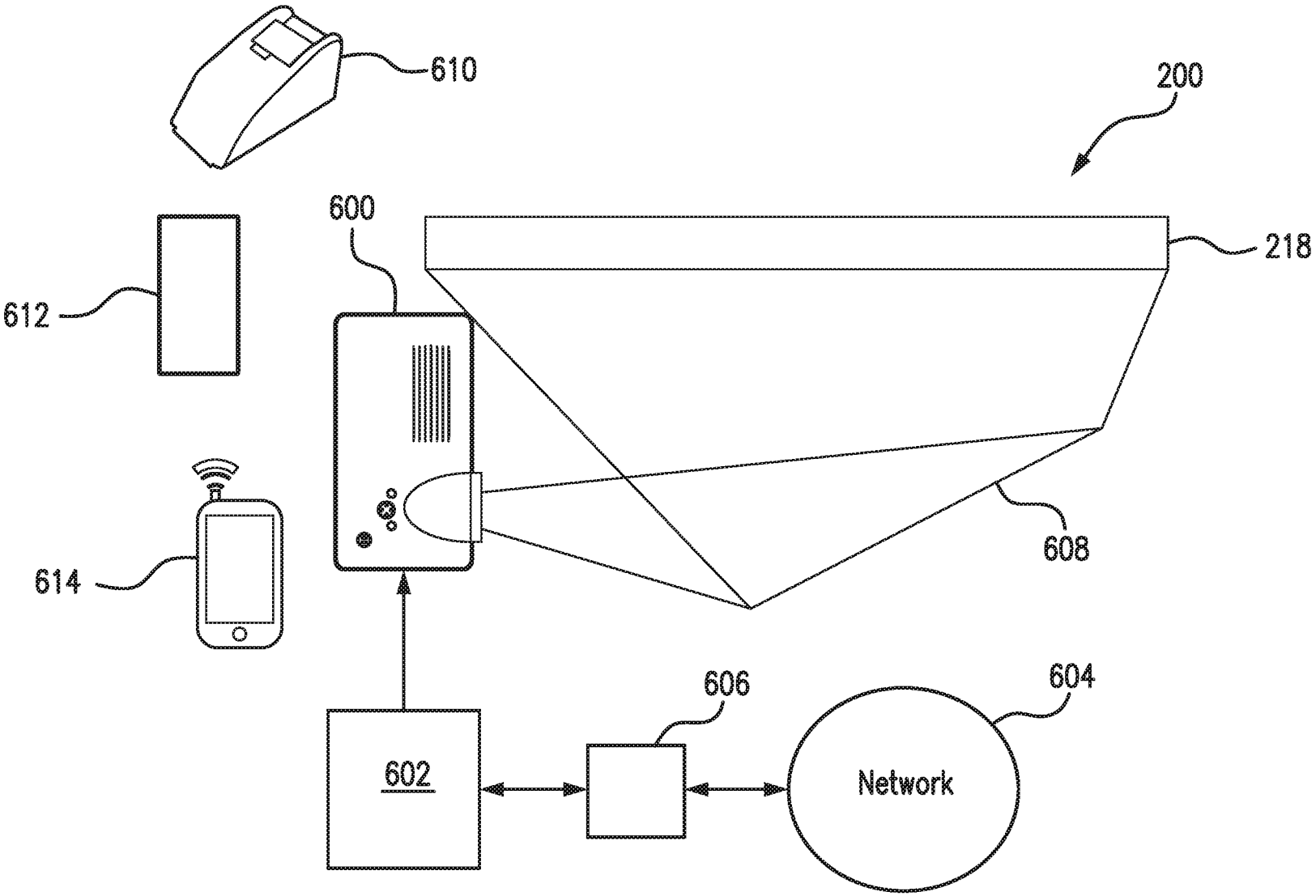
FIG. 6 illustrated the acquisition and projection of content through the table top to be displayed thereat according to an embodiment of the invention.

To provide a source of image content FIG. 6 illustrates an example of the image source as a digital light projector 600 which may be located in the chamber 216 within the frame 206. The projector 600 may be a 1920×1080 digital light projector and controlled by a suitable processor 602 in communication with a network 604 through an appropriate network interface 606. The network 604 may be a wired network or wireless. Content for display may be stored locally at the projector 600, processor 602 or at an appropriate local or remote server in or accessible through the network. The image source content may be shared such as the processor 602 providing video content to the projector 600 for display such as the layout for a game of Blackjack where the dynamic content such as bonuses, progressives, celebration effects, casino property information and player loyalty account information would be streamed to the processor 602 or projector 600. Content may be downloaded to one or more of the projector 600 and processor 602 for display such as new table game layouts and other information. Through the network 604 augmenting content such as, for example, information unique to the table, its status such as available or not available for play, advertising or the like may be provided for display by the projector 600.

The content provided by the projector 600 may be directly cast through the transparent substrate 400 and compressible layer 408 to the underside of the cloth 402 of the top 218 which is displayed to the players/dealer or, as shown in FIG. 6, the content from the projector 600 may be reflected by a mirror 608 and then cast to the underside of top 218 to the same effect. Where the optical path requires on or more mirrors may be provided to cast the content as desired to the underside of the table top 218 for display to the players/dealer. Other reflectors such as prisms, glass may be used alone or in combination with mirrors.

The network may also include one or more player tracking and electronic account servers which provide and receive information for the table as described herein. For example player loyalty account information or player electronic account information are available for display at the table 200. Other servers may manage content such as advertising or attract-mode graphics at the table.

In an embodiment the processor 602 may be included in a configured dealing card shoe 610 or shuffler 612 as disclosed in Oliver et al, U.S. Pat. No. 9,896,677 filed Aug. 4, 2008 and titled "Modular dealing Shoe for Casino Table Card Games" and Downs III et al, U.S. Pat. No. 9,387,390 filed Sep. 16, 2013 and titled "Card Shuffling Apparatus and Card Handling Device". For example the card shuffler 612 processor may be programmed to act as processor 602 to control the projector 600 or video displays to display some or all of the desired content. In an embodiment the shuffler 612 or shoe 610 processor may instead be programmed to communicate with the processor 602 to select or co-process program data to control the projector 600 or video displays to display some or all of the desired content. For example the processor 602 may be programmed with data files for a number of game and display feature programs. The shuffler 612 or shoe 610 when installed at the table 20( )would communicate with the processor 602 to provide for the selection of the desired game or display program. The shoe 610 or shuffler 612 may be programmed to enable casino personnel to install and activate the shoe 610 or shuffler 612 and via a dealer input select the game and related display features such as bonuses and other information. Selection of a game at a shuffler is disclosed in Sines, et al, U.S. Pat. No. 8,967,218 filed Sep. 28, 2012 and titled Card Shuffling Apparatuses and Related Methods". In an embodiment the processor 602 and network interface 606 may be incorporated into the shoe 610 or shuffler 612 to control the projector 600 or video display(s) to display the desired content from a local or network source.

In an additional or further embodiment the displays at the table 200 under the various embodiments described above may be configured wirelessly with a mobile device 614.

Figure 7:
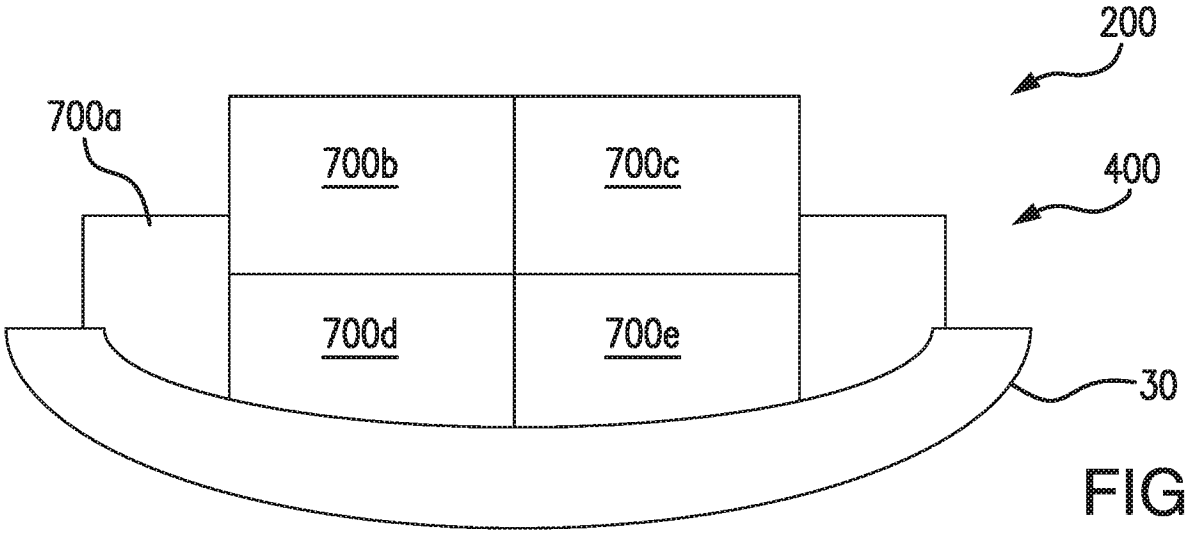
FIG. 7 shows an embodiment of the present invention using plural video display monitors as the table top substrate.

In an alternate embodiment the table top 218 substrate 400 may be fashioned from one or more video displays 700*a-f* configured or arranged to define the desired shape of the top 218 and the areas thereof where the display of content is desired as suggest in FIG. 7. In such an arrangement the video displays 700*a-f* are arranged in an abutting or "tiled" relationship and the compressible layer 408 is provided over the displays 700*a-f* (individually or as a composite group or as several subgroups) in the manner described above and as suggested in FIG. 8. The cloth 402 is then secured over the compressible layer 408 in the manner described above and the bumper 28 is attached. According to this embodiment the desired content is provided by the video displays 700*a-f* and hence the projector 600 and mirror 608 of FIG. 6 are not required. The video displays 700*a-f* may be LED, OLED or other digital video displays and are controlled by processor 602 to provide individual or synchronized video content which passes through the transparent compressible layer 408 to the underside of the cloth 402 for display to the players and dealer.

To provide touch input the video displays 700*a-f* may include touch input capability. When a player or the dealer touches and depresses the top surface of the cloth 402 the compressible layer 408 transfers the touch to the surface of the video display 700*a-f* to provide touch input.

Figure 5B:
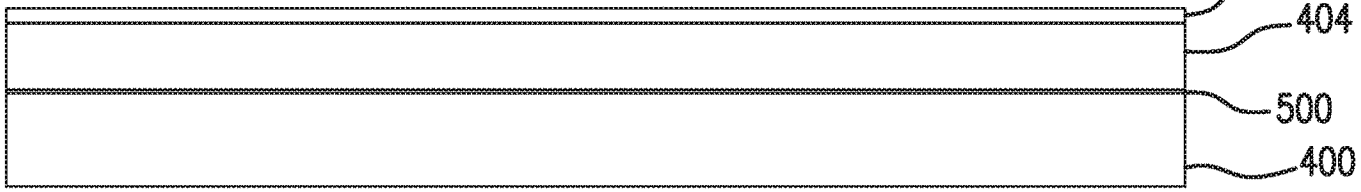
Figure 5C:
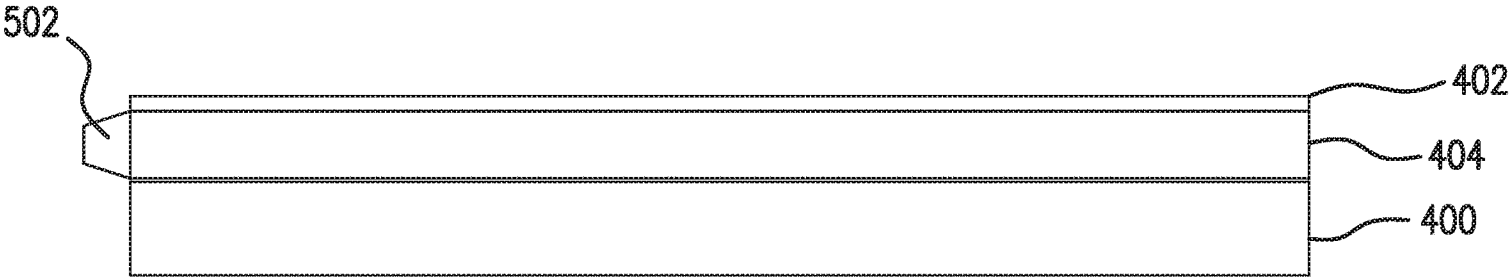
Figure 5D:
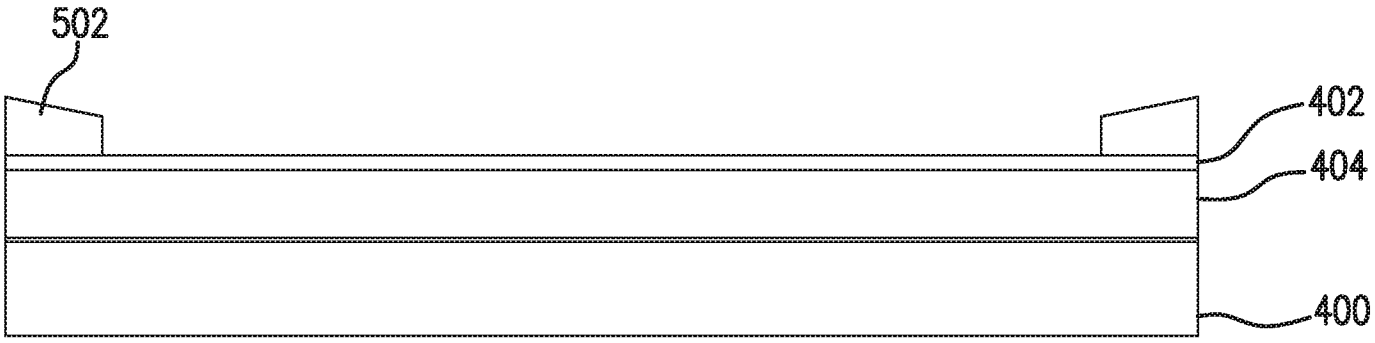
Figure 5E:
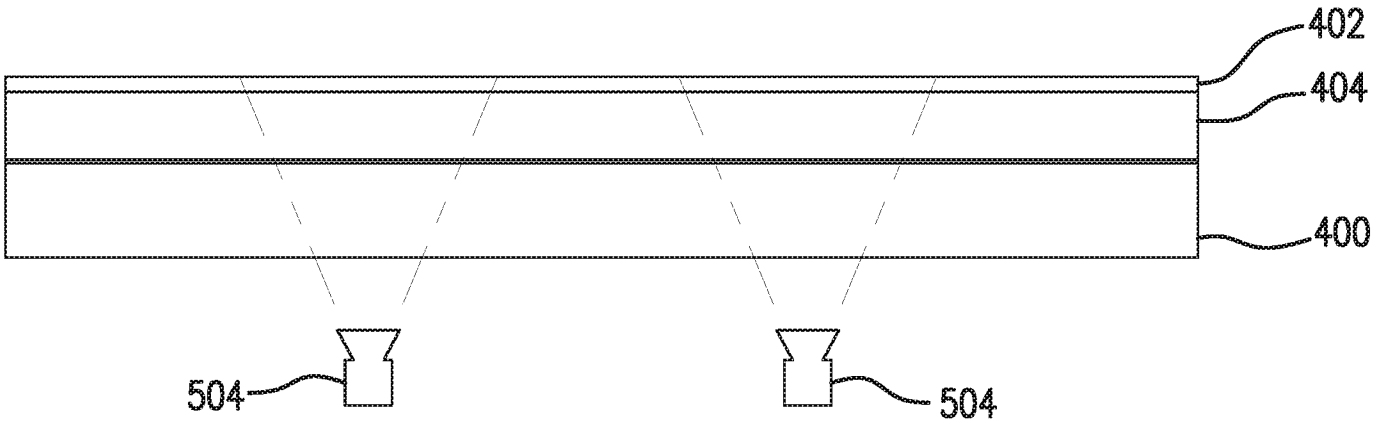

Turning to FIGS. 5B-5E touch input functionality can be provided to the table 200 top 218 of FIG. 5A where the substrate 400 is a transparent glass or plastic. FIG. 5B illustrates a cross-section of the top 218 provided with a optically transparent projected capacitive touch sensor layer 500 of, for example, nano-wire, ITO (Indium Tin Oxide) or thin wire mesh. Signals from the layer 500 are provided to the processor 602 or an intermediate touch controller (not shown). FIG. 5C illustrates an alternate embodiment for providing touch functionality and shows a network of infrared light emitters/sensors 502 arranged to project/receive emitted light through the compressible layer 408. When a player or the dealer touches the cloth 402 it is depressed to interrupt the light with interruption being detected and provided as a signal indicative of the location of a touch. Signals from the sensors 502 are provided to the processor 602 or an intermediate touch controller (not shown). FIG. 5D shows yet another approach to provided touch functionality to the top 218. In this arrangement the infrared light emitters/sensors 502 are arranged at the upper trim 312, for example, to broadcast/receive light sent across the top of the cloth 402. A player or dealer touch on the cloth 402 interrupt the light and the location of the interruption is detected and provided as a signal indicative of a touch to the processor or through an intermediate controller (not shown). FIG. 5E shows another technique for provided touch functionality to the top 218. In this embodiment touch one or more touch sensing cameras 504 are arranged to capture the underside of the top 218 as by being located in the chamber 216. The images from the cameras 504 are processed to determine changes in the images indicative of a touch at the cloth 402 such as a finder tip, swipe of a finger or hand or the like.

Figure 9:
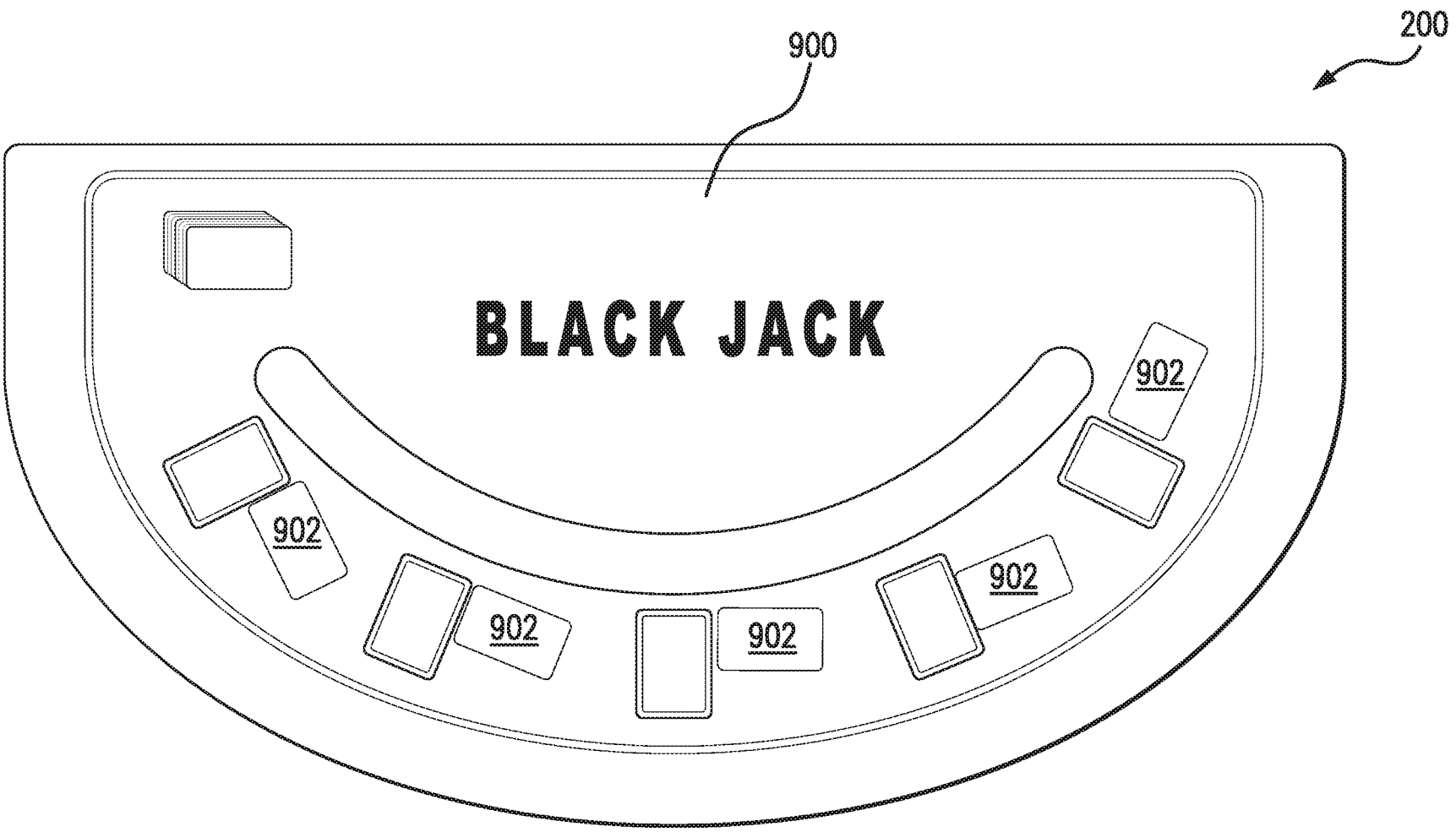
FIG. 9 illustrates a composite Blackjack table top along the lines of FIG. 1A and including video display/mobile binding windows provided according to the present invention.

To provide certain functionality as described herein to a table, certain regions or window may be provided in an otherwise opaque top as illustrated in FIG. 9. According to this embodiment a printed felt fabric 900 is provided with the diffuse, non-opaque synthetic cloth layer windows 902 suitable for backlighting for the purposes described above. The windows 902 may be a woven fabric, polymer or glass composite surface such as the Crystal Silk™ or Celtic Cloth also described above and incorporated into the felt fabric as by stitching, heat bonding or gluing. The fabric 900 is secured over the compressible layer 404 as described above. One or more projectors 600 or video displays are arranged to project video content to the underside of the windows 902 as described above. Touch functionality may be provided to the windows 902 also as described above. For example the content provided to the windows 902 may enable a player to access their loyalty account, receive promotions, display information and enable interactive access an electronic account (eWallet) to provide or deposit funds and the like.

Occasionally a player may damage the top 218 by dropping a cigarette on the cloth 402. It has been found that the cloth 402 and compressible layer 404 as described herein is flame retardant; however a cigarette of cigar will locally melt the cloth 402 and compressible layer 404. To repair the table top 218 the cloth layer 402 is removed for replacement or repair. The area of the compressible layer 404 which is damaged is cut out and discarded. The compressible layer 404 material in its liquid form is prepared and poured into the cut out and allowed to cure. It has been found that the "patch" to the compressible layer 404 does not affect the quality of the displayed content in any perceptible manner. A new or repaired cloth layer 402 is secured over the compressible layer 404 and the table 200 is returned to service.

The various embodiments of the table 200 provide several advantages over traditional tables. The table 200 provides a standard gaming table look, feel and footprint on the casino floor. Cashless play can be accommodated inasmuch as the dealer or players can use virtual funds displayed and accounted for at the table 200. In an embodiment TITO functionality may be provided at the table 200, for example associated with each player position, to enable players to use tickets to establish credits at the table 200 for gaming and to cash out. Touch input functionality associate with the player positions enables players to select to cash out. A player loyalty system interface may also be displayed at the table to support the player loyalty system and send content to the player and receive inputs from the player. The displayed content may also support electronic accounts. Touch functionality enable a player to call up their account, input their credentials, e.g. PIN number, and download funds to the table 200 for gaming as well as upload funds to their account to cash out from the game.

The embodiments of the table 200 described above support gaming where a live dealer controls the action and the game. However in an additional embodiment the table 200 may be incorporated into an electronic table where a virtual dealer such as at a large video display is provided and the action is virtually controlled. Players, using the touch screen functionality at the table can provide inputs such as wagers and game play decisions at the table top 218 which provides the feel and look of a traditional table.

While the methods and table described have been directed to a gaming table such as a Blackjack table it should be understood that the table 200 could be a craps, Roulette, Sic Bo or other table. Further the methods and construction could be incorporated into other tables such as billiard or pool tables.

The table 200 described herein enables the user to quickly change the game by simply calling from memory the appropriate graphics and functions to support the new game which is displayed at the cloth 402 for the players. For example a casino may wish to operate a Blackjack tournament and requires, for example, certain Pai Gow tables to be converted to Blackjack to support the volume. This can easily be done by simply changing the display program that the Pai Gow tables to Blackjack. Further features such as progressive side bets for table games, different pay tables and other game information can be displayed. New games may easily be displayed on a trial basis to elicit player acceptance. Additionally functionality not available on felt games such as touch functionality and feedback can be provided to support, for example, player tracking, TITO and electronic account transactions.

Binding a Mobile Device to the Digital Table

As aspect of the present invention includes features which enable a user of a mobile device such as a mobile telephone to bind their device to a location on the table surface for purposes of receiving content targeted to the user from a local or remote source and for providing prompts, instructions or responsive inputs from the mobile device.

Modern mobile devices, such as a Galaxy S7 manufactured and sold by Samsung and others, features/utilities such as: processing capabilities, memory, a digital camera with a flash, communication capability such as WLAN (i.e. WiFi), Bluetooth Low Energy (BLE), Global Positioning System (GPS), Near Field Communication (NFC), an AMOLED touch screen display supporting multi-touch and sensors such as an accelerometer, gyro, proximity sensors and a compass. According to the present invention these features can be leveraged to bind a mobile device to a location at a surface such as a gaming table surface.

Figure 10:
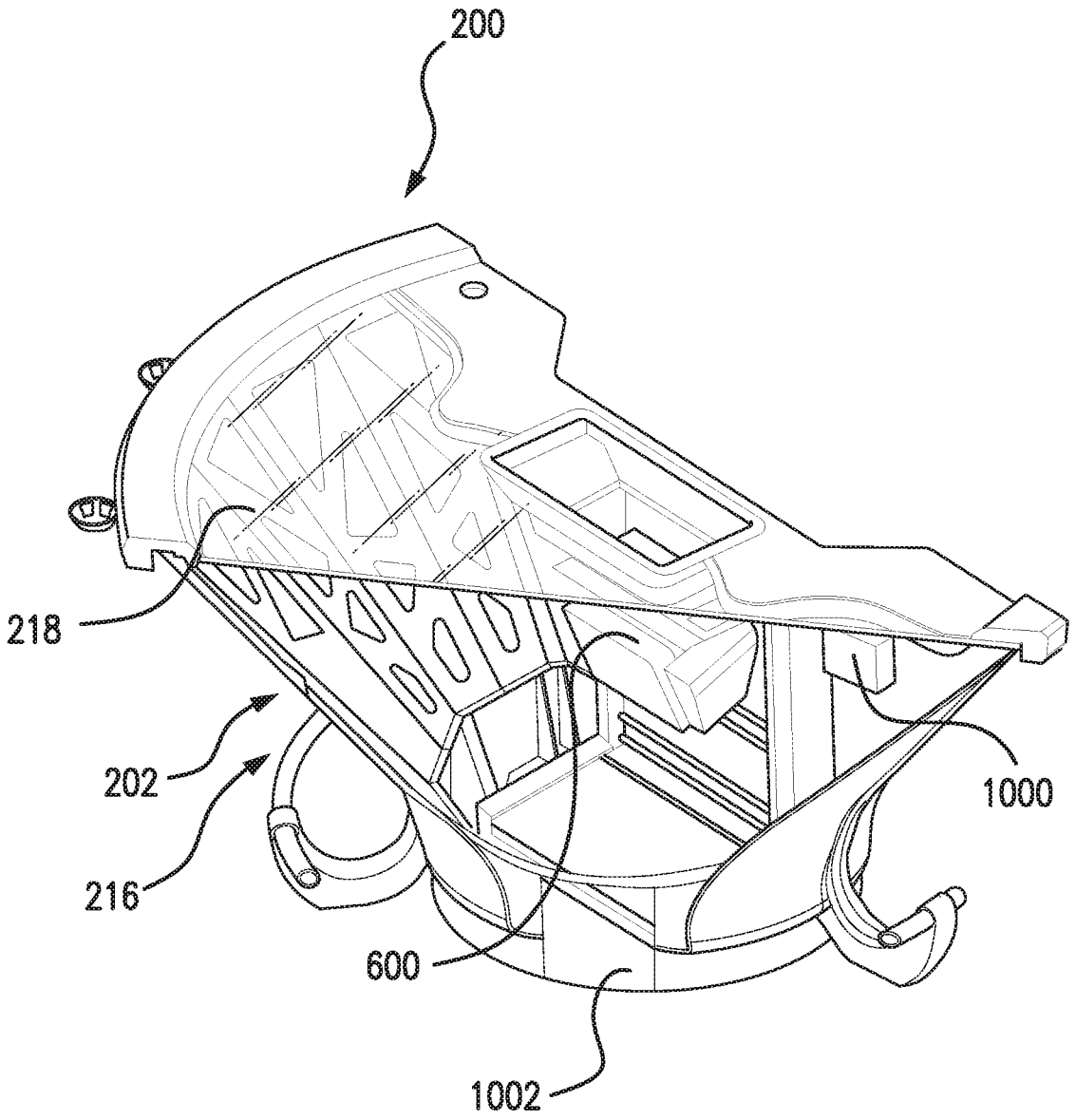
FIG. 10 is a break away view of the Blackjack table of the present invention illustrating a location for the surface transceiver and optical receiver.

Turning to FIG. 10, the table 200 is shown including the optically transmissive top 218 as described above. The pedestal 202 supports the top 218. As described above a digital projector 600 is disposed within the interior chamber 216. In this embodiment the table 200 and projector are configured to not require an optical path-folding mirror 608 as described above and hence the mirror 608 is not shown in FIG. 10. It should be understood that if necessary, due to the optical path of the content from the projector 600, a mirror 608 is required it would be located in the interior chamber 216 as described above. Also disposed in the interior chamber 216 is a wireless transceiver 1000 which is in communication with one or more of the processor 602 and network 604 for purposes which will become apparent. An optical receiver 1002 such as a digital camera is also located in the interior chamber 216 and is arranged to be upward looking to capture the underside of the top 218. Image data captured by the optical receiver 1002 is provided to the processor 602 or over the network for remote processing for purposes described below.

The table 200 can support any number of players. Players need not sit at any particular position. Further inasmuch as the table 200 can support different games the number and arrangement of player positions may be dynamic.

Initially a player installs an application on their mobile device to support the binding functionality described below. This application may be installed, for example, when the player enrolls in a casino loyalty program and/or establishes an electronic funds eWallet account. The application may be downloaded from an application store or a casino venue website. The application may be stored in memory on the mobile device in its entirety or the application may rely in some respects upon remote storage/processing such as through any one of communication networks such as near field BLE or WiFi commnunication with a hub in the casino and to the Internet.

Figure 11:
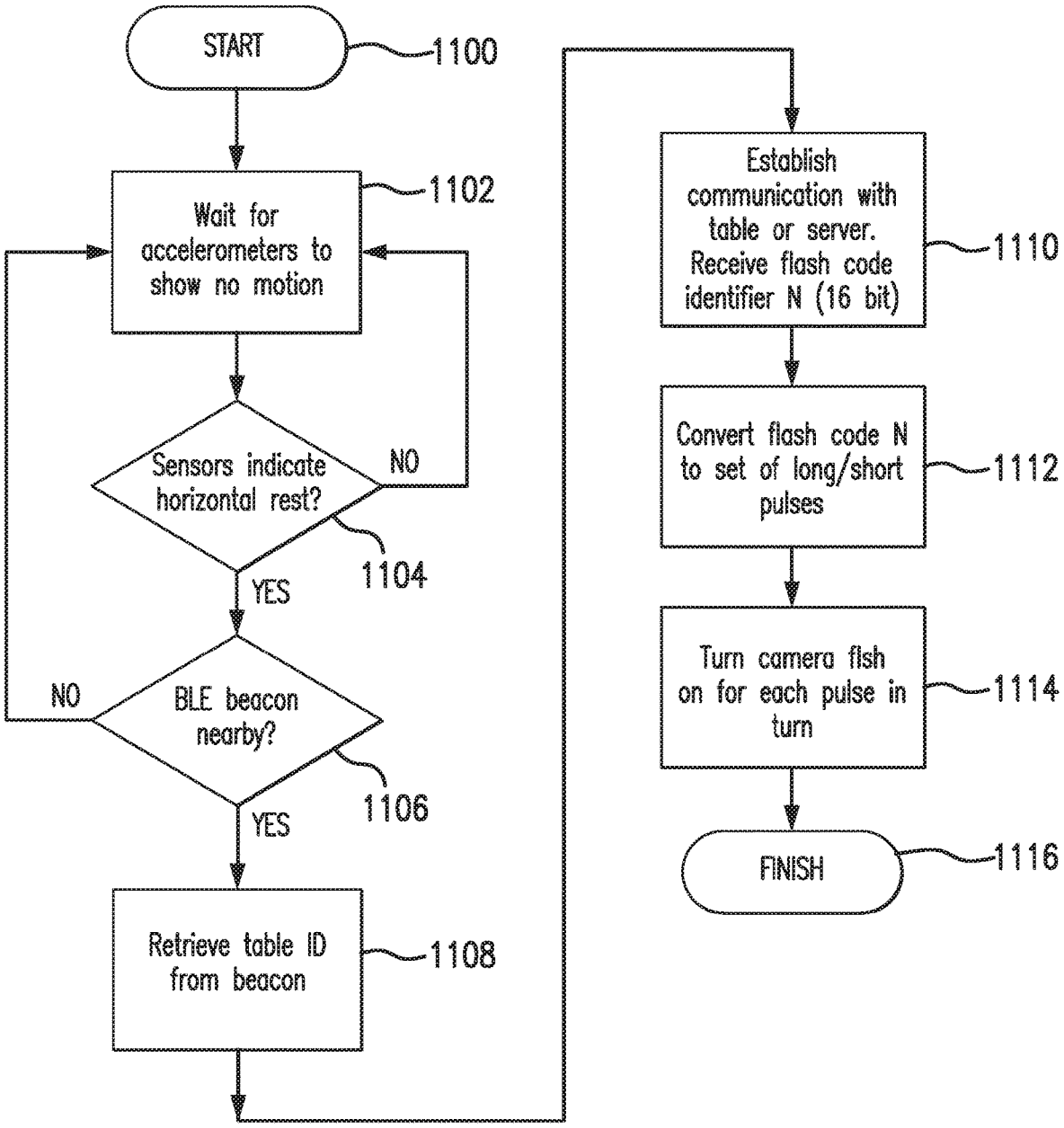
FIG. 11 is a logic diagram illustrating the proximity and locational binding of a mobile device to the gaming table.

To bind the player's mobile device to the proximity of a table top 218, the player has their device and its wireless utility turned on. The process starts at 1100 in FIG. 11 with application determining that certain conditions are satisfied. At 1102 the application determines whether the mobile device is in an "at rest state" by analyzing data from the accelerometer. If not this state is repetitively polled for the "at rest state" determination. If it is determined at 1102 that the device is at an at rest state the application sources the gyro to determine at 1104 whether the mobile device is resting in a substantially horizontal state indicative that the device has been laid upon the top 218. If both the conditions of being at rest and horizontal are determined at 1106 the application determines if a BLE beacon from a wireless transceiver 1000 is detected nearby. The wireless transceiver is configured to broadcast a BLE beacon and look for a mobile device to detect the beacon and initiate a wireless handshake between the digital table 200 and the mobile device. Satisfaction of these conditions indicate that the player has rested their device in a horizontal position on the top 218. If the conditions of resting horizontally or a nearby beacon signal do not exist the application repeatedly tests for satisfaction of those conditions to determine that the device has been laid upon the top 218. Inasmuch as the BLE beacon is short range, detection according to the above provides proximity location at the top 218 but has not yet determined a precise position of the mobile device, to the exclusion of other mobile devices on the top 218, and places the mobile device and wireless transceiver 1000 in wireless communication.

The beacon signal from the transceiver 1000, to establish the handshake between the mobile device and table 200, may include a data code such as an identification number or other code identifying the table 200 or table area. At 1108 this table identification code is retrieved from the beacon signal by the mobile device.

During the handshake sequence data is exchanged between the mobile device and the transceiver 1000 to also identify the mobile device, such a through its mobile identification number (MIN) assigned to the device by the mobile subscription carrier or the International Mobile Station Equipment Identity (IMEI) number or a player account number perhaps assigned when the player enrolls in a casino loyalty program or installs the application. Based upon this data exchange the system now identifies the specific mobile device is on the table top 218. This handshake also enables access to the player's loyalty and eWallet accounts either through the transceiver 1000 or through a cabled, WiFi or broadband backchannel.

To bind the mobile device to a specific location or "seat" at the table top 200 at 1110 through one or more of the wireless BLE signal or a companion WiFi or broadband communication link a "flash code" identifier N is provided to the mobile device application. The code N may be a 16 bit code. The code N can be re-used at a table so it need not be unique and could be as small as a 4 bit code. The mobile device application converts at 1112 the code N into data representing the code N as a series of short and long camera flashes, e.g. long flashes for "1" and short flashes for "0". At 1114 the application turns the camera flash on for each "flash" pulse of the code. The flashes transmit through the transmissive top 218 (or a window thereof) and are detected by the optical receiver 1002 which generates data representing the source location for the flashes and the transmitted code N sends that data to the processor 602 or to a system backend server over the backchannel. The flash and location data is processed to bind the specific and known mobile device to a specific location on the top 218. Using the same technique mobile devices of other players may be bound to other specific locations at the top 218. At 1116 the process is completed.

Figure 12:
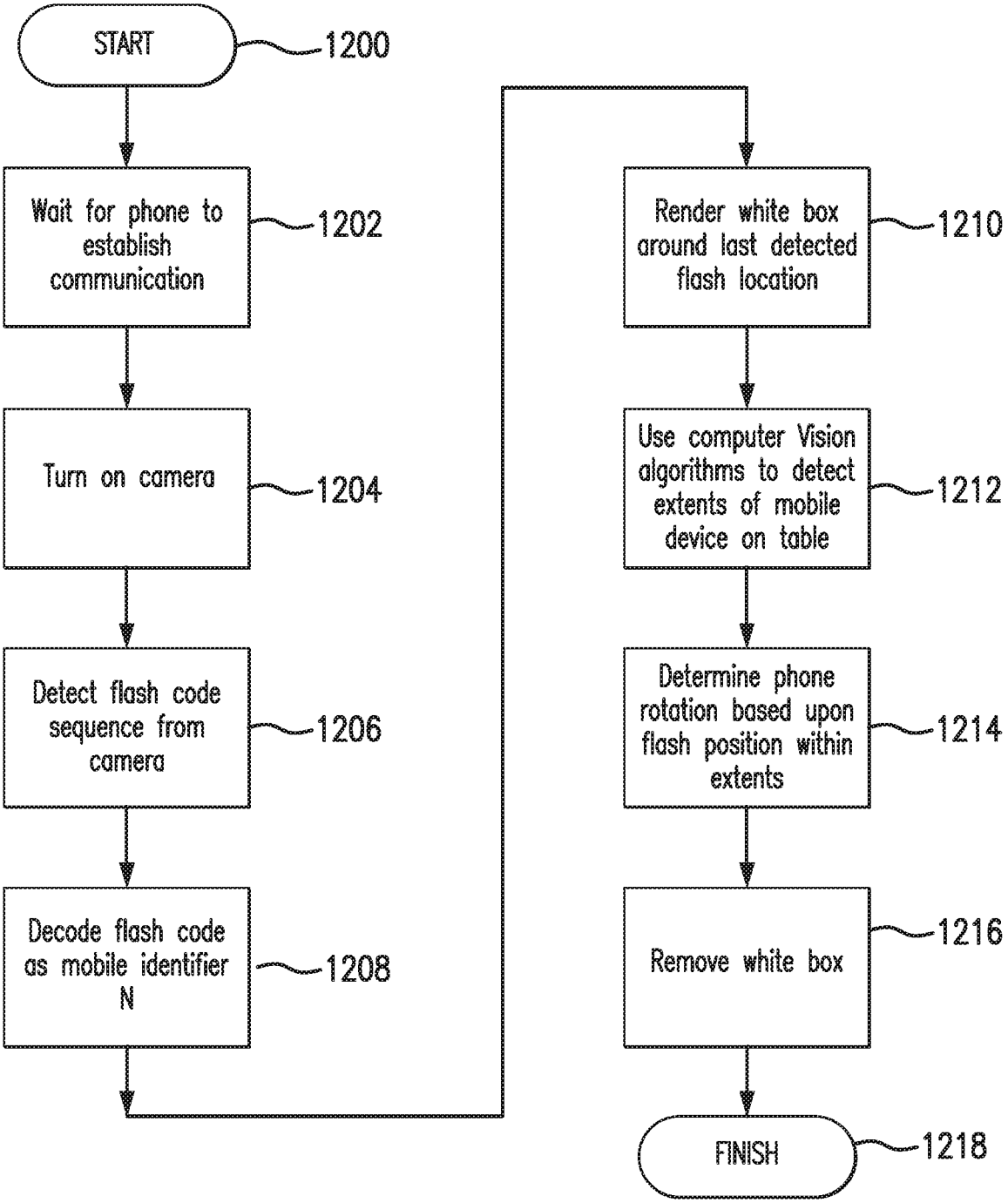
FIG. 12 is a logic diagram for illustrating the proximity and locational binding of a mobile device to the gaming table including determining the orientation of the mobile device.

To provide content to a position on the top 218 to which a mobile device has been bound the process according to FIG. 12 may be used. At 1200 the mobile device is turned on as are the utilities of the accelerometer, wireless communication (including near range, WiFi) and at 1202 the process waits for the beacon to be detected and the mobile device communication handshake is established as described above. Also as described above at 1204 the mobile device camera is accesses by the mobile application and the flash code is digested and broadcast to issue the flashes through the table top 218. At 1206 the optical receiver 1002 detects the flashes and their location on the top 218 and at 1208 the flashes are decoded to now bind a specific, known mobile device to a specific location on the top 218. To determine the orientation of the mobile device resting on the top 218, i.e. whether it is laying to provide its video display to the player in a landscape or portrait mode or somewhere in between, the processor 602 is controlled at 1210 to project with the DLP 600 a white box or rectangle "halo" through the top 218 and at the determined location of the flash code emitted by the mobile device. The projected box at the top 218 is visible to the player and also, from the underside of the top 218, produces an observable shadow or image of the footprint of the mobile device which is detected by the optical receiver 1002. The data from the optical receiver corresponding the location and shadow image is provided to the processor 602 which at 1212 processes the data using computer vision algorithms and at 1214 determines the rotational orientation of the mobile device at the determined location. When the orientation has been determined the projector 600 discontinues projection of the white box at 1216 and the process is complete at 1218.

By virtue of the processes described above the projector 600 can be controlled to provide content to the mobile device location positioned above, below, around or to the sides of the mobile device footprint. For example promotions, advertising and player account information may be displayed on the top 218 to the side and adjacent to the mobile device footprint such as not to be obscured by the mobile device itself.

Figure 13:
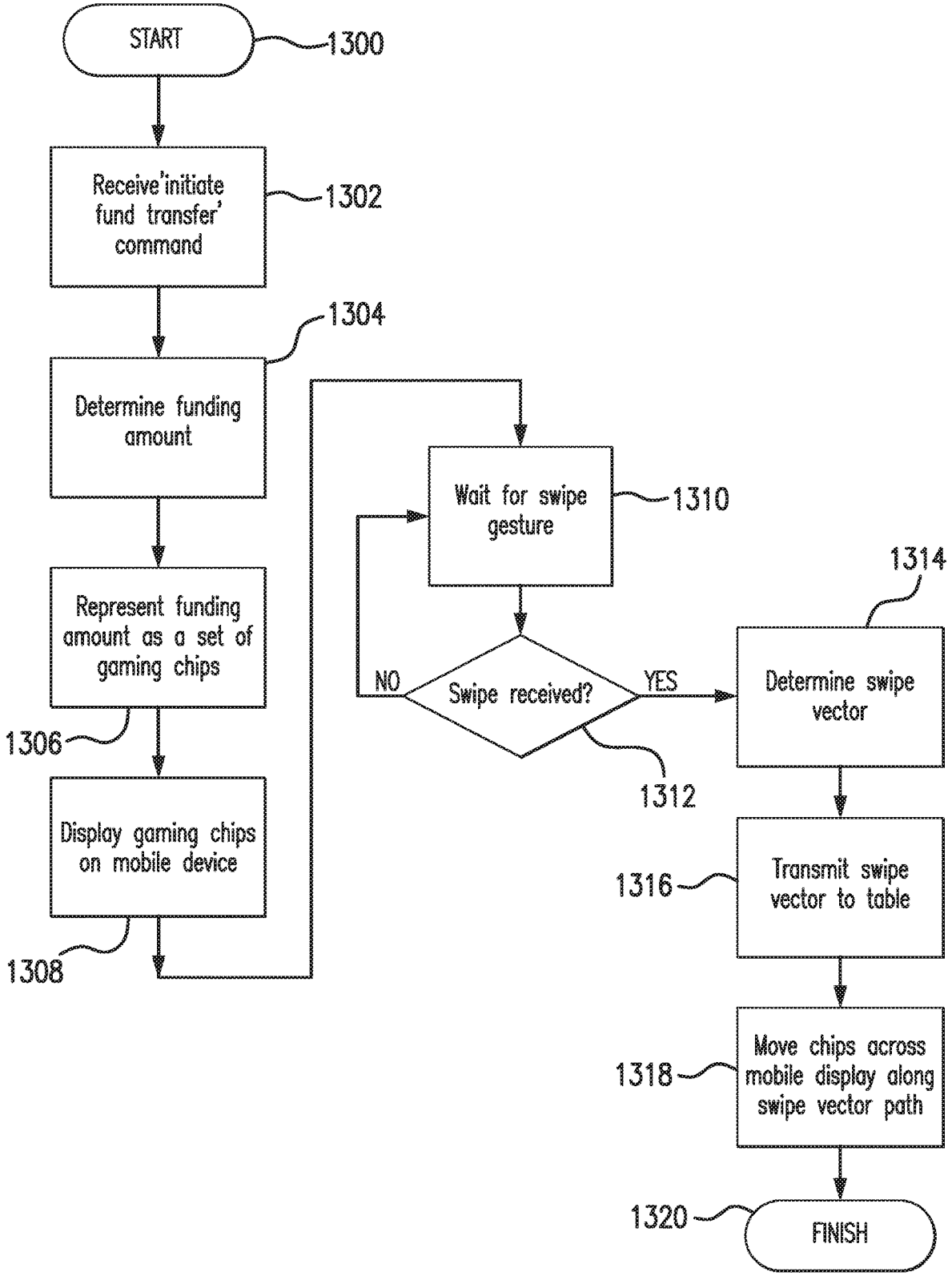
FIG. 13 is a logic diagram illustrating mobile device and gaming table inter-communications to transfer funds in the form of virtual gaining chips.
Figure 14:
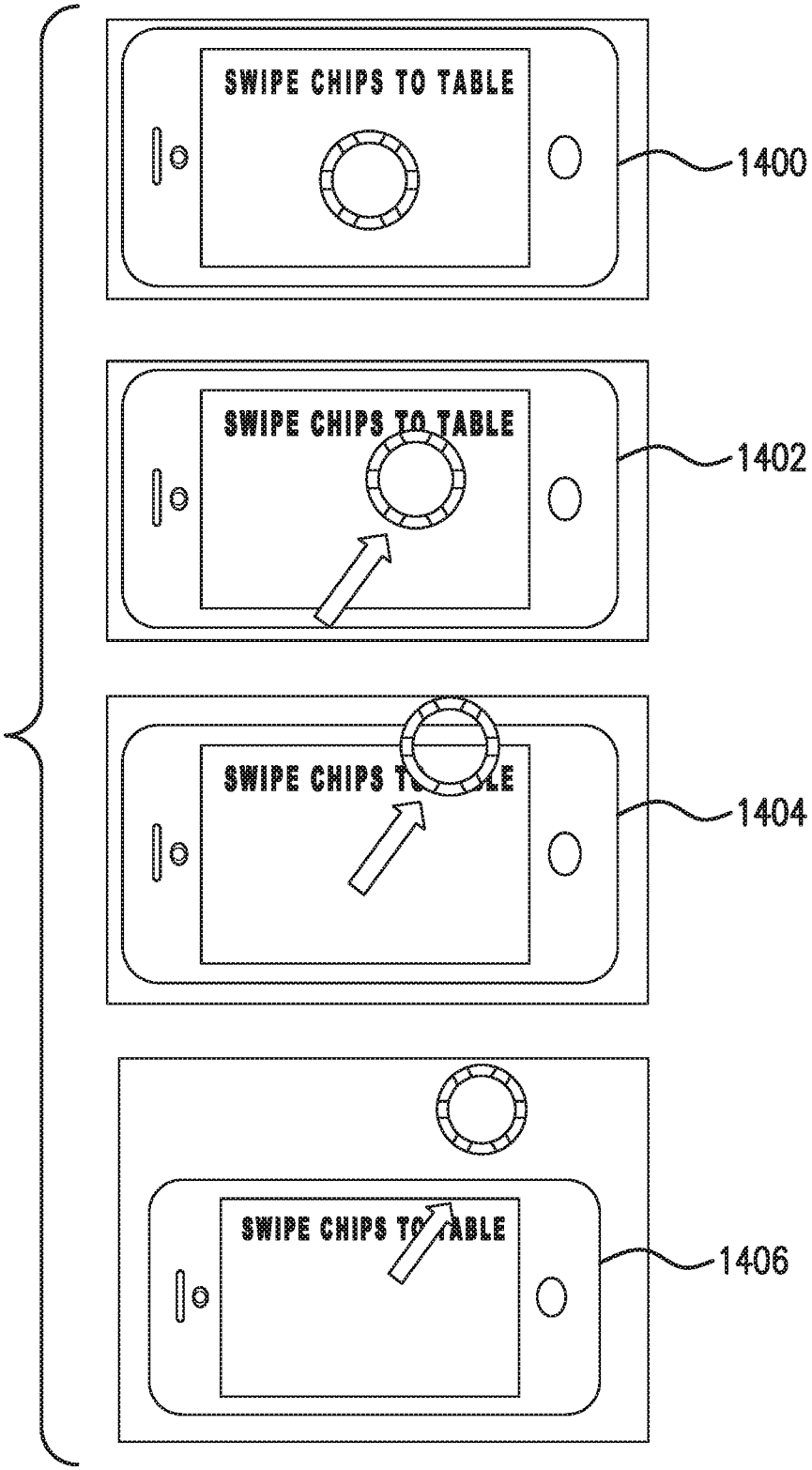
FIG. 14 illustrate a sequence of view of the mobile device display for swiping icons for virtual gaming chips from the mobile device to the gaming table digital surface.

Turning to FIGS. 13 and 14 a feature available through the mobile binding and providing content on the top 218 associated with the location described above is illustrated. At 1300 a process for moving funds stored on the mobile device or at a remote system hosted eWallet account to the table 200 is initiated. The player on their mobile device at 1302 enters a command to transfer funds which is received by the transceiver 1000. The transceiver 1000 may route the command through the processor 602 or system router over a backchannel to a back end server hosting a player's eWallet account. Alternatively or additionally the command may be received by a WiFi router or though the mobile device's broadband network and routed to the back end server hosting the player's eWallet account. Alternately or additionally the funds may be stored on the mobile device itself in an account file perhaps initially funded through a previous transaction. The player, using their mobile device touch display enters an amount he wishes to transfer to the digital table 200 for gaming at 1304. The mobile device application or the back end system at 1306 confirms available electronic and at 1308 controls the video display for the mobile device to display the requested funds as one or more gaming chips or lammers representing the requested value. An example of a display of a single chip is shown at 1400 in FIG. 14. In another example, if the player has requested $250 the application may control the mobile device display to display two $100 chips and two $25 chips. In an embodiment the requested value may be represented as a currency or other icon(s). To transfer value to the digital table 200 for gaming the player need merely use a swiping touch gesture on the video display for their table-bound mobile device. At 1310 the application waits for this swiping gesture and if at 1312 a swiping touch gesture is received the application at 1314 analyses the touch gesture vector, e.g. direction and also transfers this swipe vector to the digital table processor 602 at 1316 though one or more of the communication links such as the BLE communications. At 1318 the application controls the mobile device video display to depict the movement of the gaming chip image in the direction of the vector to appear to move the chip from the mobile device onto the digital table 200 as shown in the sequences at 1402, 1404 and 1406 of FIG. 14. At 1406 the digital table processor 602 control the DLP 600 to display the virtual chip on the digital table top 218 surface adjacent the bound location of the mobile device and in a position at least approximately defined by the determined swipe touch gesture vector. At 1320 the funds transfer process is finished. The transferred funds are now available for play on the digital table.

When a player desires to terminate his/her gaming session including their mobile device bound to the electronic table, they need merely pick up their mobile device from the bound location. The application determines or reports to a remote processor the accelerometer indications of movement. At this point the system may display a query at the mobile device as to whether the player wishes to quit the gaming session and if the player inputs a positive response the session is terminated and any remaining virtual funds in play are automatically uploaded the player's eWallet or a temporary account resident in the mobile application. In a parallel or alternative embodiment when movement is indicated any remaining virtual funds in play are automatically uploaded the player's eWallet or a temporary account resident in the mobile application. In another parallel or alternative embodiment when movement is indicated and the near range communication link is severed, indicating the player is leaving the table 200, any remaining virtual funds in play are automatically uploaded the player's eWallet or a temporary account resident in the mobile application.

In one or more of the embodiments the beacon may be issued by either the mobile device or the table transceiver 1000. In one or more embodiments all or some of the processing for the binding of the mobile device may be conducted by the mobile device processor as configured by the mobile application. In one or more embodiments a system processor may handle some or most of the processing or may share data processing duties with the processor 602 for the digital table. In one or more embodiments the communication between the mobile device and the system/digital table 200 is through the near range wireless communication link such as BLE. The digital table processor 602 receives and provides data to the system, such as accessing the player's eWallet and player loyalty file, though a communicatively connected system router. In one or more embodiments some communications between the mobile device and the system/electronic table 200 are through other wireless channels such as, for example, a nearby WiFi hub or through the mobile device broadband network. In some embodiments the communications are wireless, BLE and perhaps WiFi, with a cabled network handling communications with one or more backend servers.

The transmissive surface may be other than the table top 200 described above such as a table as described in Gagner et al, U.S. Pat. No. 8,430,405 filed Nov. 14, 20101 and titled "Multi-Projection Gaming Table" or Gadda et al, US Pub App 2009/0124383 filed Nov. 9, 2007 and titled "Apparatus for Use with Interactive table Games and Methods of Use". The transmissive surface may be embodied as a merchant counter such as, for example, a counter surface at a mobile device store where mobile devices can be placed on the surface and content can be displayed on the surface adjacent to the position and data can be exchanged between user's devices and a system. For example a user could place their device on the surface for binding and content would be displayed adjacent to the bound mobile device such as billing information. The user may then transfer funds such as in the manner described above to satisfy the account.

The transmissive windows 902 may be any suitable configuration to transmit light for binding the mobile device to a position at the table. For example, the configuration may include providing a dual purpose for a token detector. For example the detector could read the placement of a token or the flashes from the camera flash of a mobile device for binding the mobile device to a position at the table as described above.

Each of these embodiments and obvious variations thereof is contemplated as falling within the spirit and scope of the claimed invention, which is set forth in the following claims. Moreover, the present concepts expressly include any and all combinations and sub combinations of the preceding elements and aspects.

What is claimed is:

1. A system for identifying and binding a mobile device to one of a plurality of player positions at a gaming table, the gaming table including a playing surface, the playing surface including light transmissive locations associated with the respective player positions, the mobile device including a flash device and said mobile device resting on the playing surface, the system comprising:

an optical receiver configured to receive, through one of the light transmissive locations, flash signals from the flash device, the flash signals identifying the mobile device; and a processor coupled to the optical receiver and configured to:

determine, via wireless electronic access to utilities of an accelerometer and a gyroscope of the mobile device, that the mobile device is resting on the playing surface;

electronically instruct the flash device to initiate the flash signals in response to determination that the mobile device is resting on the playing surface;

determine, in response to receipt of the flash signals via the optical receiver, which of the plurality of player positions is associated with the one of the light transmissive locations through which the flash signals were received;

bind the mobile device to the determined player position; and automatically animate movement of wagering game content presented on the playing surface in relation to a rotational orientation of a digital footprint of the bound mobile device relative to the determined player position.

2. The system of claim 1, wherein the playing surface is non-opaque at the location of each of the light transmissive locations.

3. The system of claim 1, wherein each of the light transmissive locations comprises a non-opaque window.

4. The system of claim 1 further comprising a projector disposed to project content on the playing surface at each of the plurality of player positions.

5. The system of claim 4, wherein the content highlights each light transmissive location.

6. The system of claim 4, wherein the flash signals identify the mobile device via a series of short and long flashes corresponding to respective binary zeroes and ones of a code associated with the mobile device.

7. The system of claim 4 further comprising a radio transceiver for establishing initial communication with the mobile device.

8. The system of claim 1, wherein the processor is further configured to:

project, through the playing surface from a projector positioned below the playing surface, a halo image around the one of the light transmissive locations before automatic animation of the movement of the wagering game content;

automatically detect, via a camera positioned below the playing surface, a shadow image of the bound mobile device produced by projection of the halo image; and determine, based on electronic analysis of the shadow image, the rotational orientation of the digital footprint of the bound mobile device relative to a game presentation area on the playing surface associated with the determined player position;

wherein the processor configured to automatically animate the movement of the wagering game content is configured to automatically animate the movement of the wagering game content in the game presentation area according to the rotational orientation of the digital footprint of the bound mobile device.

9. The system of claim 8, wherein the processor configured to animate the movement of the wagering game content in the game presentation area according to the rotational orientation of the digital footprint of the bound mobile device is configured to:

determine, based on the electronic analysis of the shadow image, the digital footprint of the mobile device on the playing surface; and digitally animate the movement of the wagering game content around one or more sides of the digital footprint, without said wagering game content being obscured by the mobile device.

10. The system of claim 1, wherein the processor configured to automatically animate the movement of the wagering game content is configured to:

detect player input from the bound mobile device; and animate the movement of the wagering game content on the playing surface according to the player input.

11. The system of claim 10, wherein the processor configured to animate the movement of the wagering game content on the playing surface according to the player input is configured to:

determine a vector of a swipe touch gesture applied to a display of the bound mobile device; and project, via electronic communication with a projection device, an animation of the movement of the wagering game content on the playing surface based on the vector.

12. The system of claim 11, wherein the swipe touch gesture is applied to a first instance of a virtual gaming chip presented on the display of the bound mobile device, and wherein the processor configured to project the animation of the movement of the wagering game content is configured to:

determine, in response to electronic communication with the bound mobile device after the swipe touch gesture, that the first instance of the virtual gaming chip moves, according to at least a direction of the vector, to a location at an extent of the display of the bound mobile device; and animate, at a location on the playing surface adjacent to the location of the extent of the display of the bound mobile device, a second instance of the virtual gaming chip, wherein animation of the second instance moves based on the at least the direction of the vector.

13. The system of claim 12, wherein the processor is further configured to:

determine a monetary value associated with the first instance of the virtual gaming chip, wherein the monetary value is stored in an electronic account associated with the mobile device;

electronically transfer the monetary value from the electronic account to virtual funds associated with the determined player position; and use at least a portion of the virtual funds as a wager amount in a wagering game administered at the gaming table.

14. A system for identifying and binding a mobile device including a flash device, the system comprising:

a gaming table including a playing surface and a plurality of player positions, the playing surface including light transmissive locations associated with the respective player positions, the mobile device resting on the playing surface;

an optical receiver configured to receive, through one of the light transmissive locations, flash signals from the flash device, the flash signals identifying the mobile device; and a processor coupled to the optical receiver and configured to:

determine, via wireless electronic access to utilities of an accelerometer and a gyroscope of the mobile device, that the mobile device is resting on the playing surface;

electronically instruct the flash device to initiate the flash signals in response to determination that the mobile device is resting on the playing surface;

determine, in response to receipt of the flash signals via the optical receiver, which of the plurality of player positions is associated with the one of the light transmissive locations through which the flash signals were received;

bind the mobile device to the determined player position; and automatically animate movement of wagering game content presented on the playing surface in relation to a rotational orientation of a digital footprint of the bound mobile device relative to the determined player position.

15. The system of claim 14, wherein the playing surface is non-opaque at the location of each of the light transmissive locations.

16. The system of claim 14, wherein each of the light transmissive locations comprises a non-opaque window.

17. The system of claim 14 further comprising a projector disposed to project content on the playing surface at each of the plurality of player positions.

18. The system of claim 17, wherein the content highlights each light transmissive location.

19. The system of claim 14, wherein the flash signals identify the mobile device via a series of short and long flashes corresponding to respective binary zeroes and ones of a code associated with the mobile device.

20. The system of claim 14 further comprising a radio transceiver for establishing initial communication with the mobile device.

21. A method for identifying and binding a mobile device to one of a plurality of player positions at a gaming table, the gaming table including a playing surface, the playing surface including light transmissive locations associated with the respective player positions, the mobile device including a flash device and resting on the playing surface, the method comprising:

receiving, at an optical receiver via one of the light transmissive locations, flash signals from the flash device, the flash signals identifying the mobile device;

determining, by a processor, which of the plurality of player positions is associated with the light transmissive location through which the flash signals were received;

determining, via wireless electronic access to utilities of an accelerometer and a gyroscope of the mobile device, that the mobile device is resting on the playing surface;

electronically instructing the flash device to initiate the flash signals in response to determination that the mobile device is resting on the playing surface;

binding the mobile device to the determined player position; and automatically animating movement of wagering game content presented on the playing surface in relation to a rotational orientation of a digital footprint of the bound mobile device relative to the determined player position.

22. The method of claim 21, wherein the playing surface is non-opaque at the location of each of the light transmissive locations.

23. The method of claim 21, wherein each of the light transmissive locations comprises a non-opaque window.

24. The method of claim 21, further comprising a projector disposed to project content on the playing surface at each of the plurality of player positions.

25. The method of claim 24, wherein the content highlights each light transmissive location.

26. The system of claim 21, wherein the flash signals identify the mobile device via a series of short and long flashes corresponding to respective binary zeroes and ones of a code associated with the mobile device.

* * * * *